US009704646B2

(12) United States Patent
Francoeur et al.

(10) Patent No.: US 9,704,646 B2
(45) Date of Patent: Jul. 11, 2017

(54) FERROMAGNETIC METAL RIBBON TRANSFER APPARATUS AND METHOD

(75) Inventors: Bruno Francoeur, Beloeil (CA); Pierre Couture, Boucherville (CA)

(73) Assignee: Hydro-Quebec, Montreal (CA)

( * ) Notice: Subject to any disclaimer, the term of this patent is extended or adjusted under 35 U.S.C. 154(b) by 276 days.

(21) Appl. No.: 14/116,930

(22) PCT Filed: May 18, 2011

(86) PCT No.: PCT/CA2011/000587

§ 371 (c)(1),
(2), (4) Date: Nov. 11, 2013

(87) PCT Pub. No.: WO2012/155232

PCT Pub. Date: Nov. 22, 2012

(65) Prior Publication Data

US 2014/0097286 A1 Apr. 10, 2014

(51) Int. Cl.
*H01F 41/06* (2016.01)
*B65H 19/18* (2006.01)
(Continued)

(52) U.S. Cl.
CPC ..... *H01F 41/06* (2013.01); *B65H 19/1852* (2013.01); *B65H 19/28* (2013.01);
(Continued)

(58) Field of Classification Search
CPC ..... B65H 2701/1714; B65H 2301/44332; B65H 2301/46115; B65H 19/1852; B65H 19/28; H01F 41/022; H01F 41/06
See application file for complete search history.

(56) References Cited

U.S. PATENT DOCUMENTS 331,616 A 1/1885 Coburn et al.
1,651,840 A * 12/1927 Scott ..... B65H 19/1852 242/552
(Continued)

FOREIGN PATENT DOCUMENTS

CA 2125938 A1 12/1994
CA 2279981 A1 8/1998
(Continued)

OTHER PUBLICATIONS

International Search Report for corresponding International Application No. PCT/CA2011/000587, mailed on Aug. 15, 2011, 6 pages.
(Continued)

*Primary Examiner* — Sang Kim
(74) *Attorney, Agent, or Firm* — Bookoff McAndrews, PLLC

(57) ABSTRACT

Apparatus, system and methods for transferring of a ferromagnetic metal ribbon from a roll mounted on a mandrel to another mandrel, including a mandrel located around electrical coils of a transformer. The system includes an apparatus for securing a free end of a ribbon roll including a reel onto which the ribbon roll is mounted and a ribbon retention mechanism having retaining elements movable between a retaining position in which the free end of the ribbon roll is secured on the reel and a releasing position in which the free end of the ribbon roll is free from the reel. An apparatus and method for rolling up a cuttable ferromagnetic ribbon on a mandrel are also disclosed. An apparatus and method for rolling up a cuttable ferromagnetic ribbon on a mandrel are also disclosed. An apparatus and method for manipulating and displacing ferromagnetic material along a path are also disclosed.

28 Claims, 23 Drawing Sheets

(51) Int. Cl.

| | |
|---|---|
| ***H01F 41/02*** | (2006.01) |
| ***B65H 19/28*** | (2006.01) |
| ***B65H 75/28*** | (2006.01) |

(52) U.S. Cl.
CPC ..... *B65H 75/285* (2013.01); *H01F 41/022* (2013.01); *B65H 2301/46115* (2013.01); *B65H 2701/1762* (2013.01)

(56) References Cited

U.S. PATENT DOCUMENTS

| | | | | |
|---|---|---|---|---|
| 1,692,789 | A | | 11/1928 | Young |
| 2,198,644 | A | * | 4/1940 | Wettengel ..... B21C 47/24 193/36 |
| 2,765,908 | A | | 10/1956 | Kulka |
| 3,128,443 | A | | 4/1964 | Herman et al. |
| 3,218,001 | A | | 11/1965 | Gombos |
| 3,555,474 | A | | 1/1971 | Marcher |
| 3,565,731 | A | * | 2/1971 | Schmermund ..... A24C 5/20 156/504 |
| 3,650,389 | A | | 3/1972 | Mook |
| 3,662,308 | A | | 5/1972 | Muschong |
| 3,686,561 | A | | 8/1972 | Spreadbury |
| 3,730,811 | A | * | 5/1973 | Wendt ..... B65H 19/1852 156/367 |
| 3,774,298 | A | | 11/1973 | Eley |
| 4,024,486 | A | | 5/1977 | Klappert |
| 4,053,331 | A | | 10/1977 | Graham, Jr. et al. |
| 4,222,533 | A | * | 9/1980 | Pongracz ..... B65B 41/12 156/502 |
| 4,288,260 | A | | 9/1981 | Senno et al. |
| 4,512,824 | A | | 4/1985 | Taub |
| 4,651,412 | A | | 3/1987 | Beisser |
| 4,781,348 | A | | 11/1988 | Cutforth et al. |
| 4,782,994 | A | | 11/1988 | Raybould et al. |
| 4,995,919 | A | | 2/1991 | Taub et al. |
| 5,069,428 | A | | 12/1991 | Li et al. |
| 5,155,457 | A | | 10/1992 | Oda et al. |
| 5,168,255 | A | | 12/1992 | Poulsen |
| 5,227,745 | A | | 7/1993 | Oda et al. |
| 5,494,534 | A | | 2/1996 | Leu |
| 5,494,537 | A | | 2/1996 | Miyakusu et al. |
| 5,526,998 | A | * | 6/1996 | Ackermann ..... G03B 27/588 242/332.7 |
| 5,566,443 | A | | 10/1996 | Allan |
| 5,568,125 | A | | 10/1996 | Liu |
| 5,608,371 | A | | 3/1997 | Valencic et al. |
| 6,005,468 | A | | 12/1999 | Shirahata et al. |
| 6,249,204 | B1 | | 6/2001 | Larranaga et al. |
| 7,905,966 | B2 | | 3/2011 | Waeckerle et al. |
| 8,049,590 | B2 | | 11/2011 | Huh et al. |
| 2002/0057180 | A1 | | 5/2002 | Shirahata et al. |
| 2002/0100539 | A1 | * | 8/2002 | Harding ..... B31D 5/0047 156/157 |
| 2003/0141020 | A1 | * | 7/2003 | Hoffmann ..... B65H 19/1852 156/502 |
| 2006/0180248 | A1 | | 8/2006 | Hasegawa et al. |

FOREIGN PATENT DOCUMENTS

| | | | |
|---|---|---|---|
| CA | 2439138 | A1 | 1/2004 |
| CN | 1252106 | A | 5/2000 |
| CN | 1659289 | A | 8/2005 |
| CN | 1932692 | A | 3/2007 |
| CN | 101371321 | A | 2/2009 |
| EP | 0318322 | A1 | 5/1989 |
| EP | 0518565 | A1 | 12/1992 |
| EP | 0629900 | A1 | 12/1994 |
| EP | 0643405 | A2 | 3/1995 |
| GB | 126271 | A | 3/1920 |
| JP | S43-14422 | | 6/1968 |
| JP | S5236733 | U | 3/1977 |
| JP | S55121624 | A | 9/1980 |
| JP | S5677066 | U | 6/1981 |
| JP | S56119603 | A | 9/1981 |
| JP | S57168954 | A | 10/1982 |
| JP | S5868425 | A | 4/1983 |
| JP | S58502174 | A | 12/1983 |
| JP | S60246613 | A | 12/1985 |
| JP | S61145768 | A | 9/1986 |
| JP | S62176117 | A | 8/1987 |
| JP | S63204574 | A | 8/1988 |
| JP | H06181135 | A | 6/1994 |
| JP | H0772604 | A | 3/1995 |
| JP | H0851034 | A | 2/1996 |
| JP | H08505188 | A | 6/1996 |
| JP | 2001508129 | A | 6/2001 |
| JP | 2001510508 | A | 7/2001 |
| JP | 2002503028 | A | 1/2002 |
| JP | 2003077742 | A | 3/2003 |
| JP | 2004119682 | A | 4/2004 |
| JP | 2007035804 | A | 2/2007 |
| JP | 2008530371 | A | 8/2008 |
| JP | 2009188034 | A | 8/2009 |
| KR | 950004711 | B1 | 5/1995 |
| WO | WO 83/04340 | A1 | 12/1983 |

OTHER PUBLICATIONS

Chang-Hung Hsu and Yeong-Hwa Chang, "Effect of the Annealing Temperature on Magnetic property for Transformer with Amorphous Core", Proceedings of the 8th WSEAS International Conference on Instrumentation, Measurement, Circuits and Systems, ISSN: 1790-5117, pp. 171-175.

A.I. Taub, "A New Method for Stress Relieving Amorphous Alloys to Improve Magnetic Properties", IEE Transactions on Magnetics, vol. Mag-20, No. 4, Jul. 1984, pp. 564-570.

* cited by examiner 52
60
84

86
67
62
75
72

61
81
76
62

80
83
d
d

90°
80
77
62
71
79
85
84
0°

65
69
68
73
72
70
66
74
67
71
79
64
63
75
62
61
60

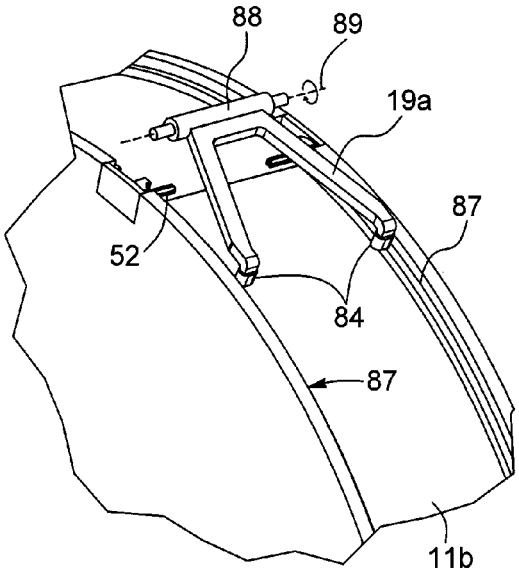
FIG. 13A
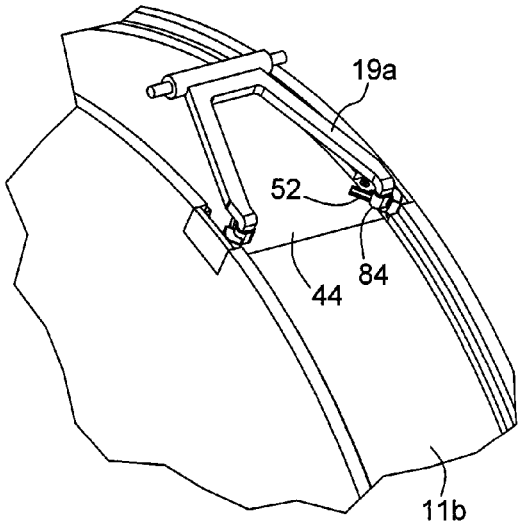
FIG. 13B
FIG. 13C
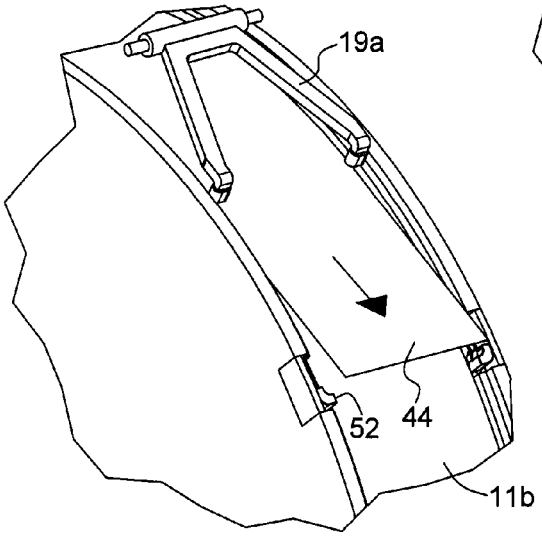

FERROMAGNETIC METAL RIBBON TRANSFER APPARATUS AND METHOD

FIELD OF THE INVENTION

The present invention relates to the handling of a ferromagnetic metal ribbon. More particularly, it relates to the transferring of a ferromagnetic metal ribbon from a roll mounted on a mandrel to another mandrel. More particularly, it relates to transferring of a ferromagnetic metal ribbon from a roll mounted on a mandrel to another mandrel located around the electrical coils of a transformer.

BACKGROUND OF THE INVENTION

Iron-based amorphous alloys are sought for their soft magnetic properties in the making of magnetic cores. They are manufactured by continuous rapid solidification of a stream of molten alloy cast on a moving chilled surface at speeds approaching 100 km per hour to output a very thin and ductile metal ribbon of various widths which can be cut at different lengths. Magnetic cores are then produced either by rolling a continuous ribbon or, by stacking multiple ribbon lengths. However, residual mechanical stresses are introduced into the alloy during casting, and applied stresses are added afterwards by bending or stacking the ribbon. These stresses will impair the magnetic properties and must therefore be removed from the ribbon when it adopts a final configuration into a core or, at least accommodated to a certain extent. Stress removal from the amorphous metal ribbon is generally accomplished by annealing the material in a furnace at an elevated temperature for a predetermined amount of time. Also, the magnetic properties are improved if a magnetic saturation field or a tensile strength is applied along the ribbon longitudinal axis during the furnace annealing treatment. Unfortunately, the furnace annealing treatment embrittles the alloy which becomes impossible to cut and difficult to manipulate. Embrittlement of iron-based amorphous alloys induced by furnace annealing has been a recurring problem for a long time.

A method for producing a distribution transformer kernel with a ferromagnetic amorphous metal ribbon is disclosed by Allan et al. in U.S. Pat. No. 5,566,443. A transformer kernel in the present document refers to the arrangement in the transformer comprising the electric coils, the core and the elements for supporting them together, without the transformer enclosure and surrounding accessories. In this patent, a number of electric coils are preformed, each having a portion with a shape of a sector of a circle. The preformed coils are then assembled together so that their portions combine to form a circular limb and, in order to construct the magnetic core, a continuous ferromagnetic amorphous metal ribbon is rolled up on a circular hollow mandrel located around the circular limb to produce a circular core. Before being rolled up, the amorphous metal ribbon has been previously furnace annealed under a magnetic saturation field on a second circular mandrel having the same external diameter as for the circular hollow mandrel, thus requiring a transfer of the annealed ribbon between mandrels.

Rolling-up-after-annealing of amorphous metal circular cores, although simple in appearance, remains a difficult task. The fact that the ribbon becomes brittle following the furnace annealing treatment makes it less convenient when it needs to be rolled up again on a second mandrel. Silgailis et al. in U.S. Pat. No. 4,668,309 have demonstrated in Table 2 of the patent that in each attempt to unroll and to roll up again a ferromagnetic amorphous metal ribbon of a furnace annealed circular core weighting around 50 kg at speeds up to 0.3 meter per second, the ribbon broke more than 60 times. Therefore, production of circular core made with rolling-up-after-annealing of an amorphous metal ribbon which has been previously furnace annealed in a roll is impractical due to the embrittlement of the amorphous alloy.

Shorter annealing times at higher annealing temperatures are believed to yield amorphous metal ribbons with greater ductility. However, there is a limit in trying to shorten the annealing time in a furnace due to a limit in heat transfer capacity within the core. Higher heat transfer capacity becomes possible by heat treating a single forwarded ribbon, under a tensile stress, in-line along a portion of its travelling path as disclosed in U.S. Pat. Nos. 4,482,402, 4288260, 5,069,428, and patent application US2008/0196795. Such apparatus are in-line ribbon annealing process. Once annealed, the ribbon is directly rolled-up on a reel mandrel or on a transformer kernel mandrel like the one disclosed in U.S. Pat. No. 5,566,443. Such apparatus would gain in productivity if means were provided at the input to maintain a continuous supply of ribbon and, at the output to ensure continuous production of rolls either on reel mandrels or on transformer kernel mandrels. According to paragraph [0080] in US patent application US2008/0196795, the output of the disclosed in-line annealing apparatus can comprise first and second winding spindles, so that it is possible, after winding a first core (or reel) over the first spindle, to cut the ribbon and to fit a head part of the ribbon onto the second spindle, in order to carry out the winding of a second core (or reel), without interrupting the manufacturing process. Paragraph [0084] further states that: it can be advantageous to use a magnetic spindle or a spindle with suction in order to immobilize the ribbon start on the spindle. However, the document does not teach nor show how to realize such continuous winding means and, does not include any means at the input for ensuring a continuous supply of ribbon.

SUMMARY OF THE INVENTION

Accordingly, it is an object of the present invention to provide methods and apparatus to overcome at least one drawback of the prior art.

According to the present invention, there is provided an apparatus for securing a free end of a ribbon roll, comprising:

- a reel onto which the ribbon roll is mounted; and
- a ribbon retention mechanism having retaining elements movable between a retaining position in which the free end of the ribbon roll is secured on the reel and a releasing position in which the free end of the ribbon roll is free from the reel, the reel comprising a mandrel with first and second lateral flanges on opposite sides of said mandrel, the flanges having respective slots for receiving the respective retaining elements, and the retaining elements comprising respective rods that are pivotable with respect to the respective first and second flanges, said rods being pivotable between the retaining position in which each rod extends towards the opposite flange, and the releasing position in which each rod extends along a corresponding side wall of its flange, and is housed within the corresponding slot of its flange.

According to the present invention, there is also a method for rolling up a cuttable ferromagnetic ribbon on a mandrel, comprising the steps of:

a) supplying a free end of said cuttable ferromagnetic ribbon in proximity of said mandrel;

b) simultaneously injecting a current by means of a controllable current source into an electromagnet located in said mandrel, to urge said free end onto the mandrel, and rotating said mandrel to roll up said ribbon on said mandrel;

c) cutting the ferromagnetic ribbon when a predetermined diameter of ferromagnetic ribbon rolled up on the mandrel has been attained.

Preferably, in step b), the electromagnet comprises at least one conductor coil of a transformer kernel.

Preferably, according to another preferred embodiment, in step b), the electromagnet comprises at least one conductor coil mounted on a ferromagnetic yoke.

Preferably, the ferromagnetic yoke is mounted on a shaft and is housed within the mandrel, the ferromagnetic yoke comprising a plurality of annular-shaped slots spaced-apart along the shaft, said slots receiving the at least one conductor coil, the at least one conductor coil being wound such that current injected in the coil circulates in alternating rotational directions between adjacent slots.

According to the present invention, there is also provided an apparatus for rolling up a cuttable ferromagnetic ribbon roll, comprising:

a mandrel;

an electromagnet located in said mandrel;

a controllable motor to rotate the mandrel;

a controllable current source for injecting a current into the electromagnet;

a controller for controlling the controllable current source and the controllable motor, to urge a free end of the ribbon onto the mandrel as the mandrel is rotating thereby rolling up the cuttable ferromagnetic ribbon roll on the mandrel; and a cutter for cutting the ferromagnetic ribbon when a predetermined diameter of ferromagnetic ribbon rolled up on the mandrel has been attained.

Preferably, the electromagnet comprises at least one conductor coil of a transformer kernel.

According to the present invention, there is also provided an apparatus for manipulating and displacing ferromagnetic material along a path, comprising:

an electromagnet;

a controllable displacement system for displacing the electromagnet along the path;

a controllable current source for injecting current into said electromagnet; and a controller for controlling the controllable displacement system and the controllable current source to sequentially capture, displace and release said ferromagnetic material as said electromagnet moves along said path.

According to the present invention, there is also provided a method for manipulating and displacing ferromagnetic material along a path, comprising the steps of:

a) positioning an electromagnet proximate to the ferromagnetic material;

b) injecting current into the electromagnet to capture the ferromagnetic material;

c) displacing the ferromagnetic material captured in step b), along the path; and d) releasing the ferromagnetic material displaced in step c) by stopping the step of injecting current into the electromagnet.

According to the present invention, there is also provided a method for transferring a ferromagnetic ribbon from a ferromagnetic ribbon roll mounted on a first reel to a first mandrel, comprising the steps of:

a) positioning the first reel at a first unrolling position;

b) securing a free end of the ribbon roll on the first reel by means of a ribbon retention mechanism having retaining elements movable between a retaining position in which the free end of the ribbon roll is secured on the first reel and a releasing position in which the free end of the ribbon roll is free from the first reel;

c) positioning an electromagnet proximate to the first reel;

d) rotating the reel with the free end secured in step b);

e) after step d), simultaneously triggering the retaining elements from the retaining position to the releasing position to free the free end of the ribbon, and injecting current into the electromagnet to capture the free end of the ribbon;

f) displacing the free end captured in step e) along a path proximate to the first mandrel at a first rolling up position;

g) simultaneously releasing the free end of the ribbon by stopping the step of injecting current in to the electromagnet, injecting a current by means of a controllable current source into a mandrel electromagnet located in said mandrel, to urge said free end onto the mandrel, and rotating said mandrel to roll up said ribbon on said mandrel; and h) cutting the ferromagnetic ribbon when a predetermined diameter of ferromagnetic ribbon rolled up on the mandrel has been attained.

Preferably, the method further comprises the step of:

i) securing a free end of the ferromagnetic ribbon rolled up on the mandrel, obtained after the cutting step h), onto the ribbon roll on the mandrel.

Preferably, according to one preferred embodiment, in step i), the step of securing comprises the step of securing the free end of the ribbon roll on the mandrel by means of a second ribbon retention mechanism having retaining elements movable between a retaining position in which the free end of the ribbon roll on the mandrel is secured on the mandrel and a releasing position in which the free end of the ribbon roll on the mandrel is free from the mandrel.

Preferably, according to another preferred embodiment, in step i), the step of securing comprises the step of welding the free end of the ribbon roll on the mandrel onto said ribbon roll on the mandrel.

Preferably, the method further comprises the steps of:

j) between steps g) and h), positioning a second mandrel at a second rolling up position proximate to the path of the ribbon between the first reel and the first mandrel;

k) simultaneously with step h), injecting a current by means of a second controllable current source into a second mandrel electromagnet located in said second mandrel, to urge the free end of the ribbon from the first reel cut in step h) onto the second mandrel, and rotating said second mandrel to roll up said ribbon on said second mandrel;

l) removing the first mandrel from the first rolling up position;

m) moving the second mandrel from the second rolling up position to the first rolling up position;

n) cutting the ferromagnetic ribbon when a second predetermined diameter of ferromagnetic ribbon rolled up on the second mandrel positioned in the second position has been attained; and o) repeating steps j) to n), until the reel positioned in the first unrolling position is empty, to unroll and roll up the ribbon roll on a plurality of mandrels.

Preferably, the method further comprises the steps of:

p) providing a second reel having a second ribbon roll at a second unrolling position proximate to the path of the ribbon between the first reel and the first mandrel;

q) securing a free end of the second ribbon roll on the second reel by means of a second ribbon retention mechanism having retaining elements movable between a retaining position in which the free end of the second ribbon roll is secured on the second reel and a releasing position in which the free end of the second ribbon roll is free from the second reel;

r) rotating the second reel with the free end secured in step q);

s) during the repeating step o) before the first reel becomes empty, triggering the retaining elements of the second reel from the retaining position to the releasing position to free the free end of the second ribbon roll and joining the free end of the second ribbon with the first ribbon of the first reel;

t) after step s), removing the first reel from the first unrolling position, after the first reel is emptied;

u) after step t), moving the second reel from the second unrolling position to the first unrolling position; and v) repeating steps p) to u) continuously, to unroll ribbon rolls continuously from the reels.

Preferably, in step s), the step of joining comprises the steps of:

i) injecting a current by means of a controllable current source into an electromagnet located in an attractor roller, to urge the free end of the second ribbon onto the first ribbon; and ii) after step i) welding the first and second ribbons together.

Preferably, in step ii), the step of welding is carried out by a rotating welder which is mounted on a shaft and comprises a plurality of conductor discs separated by insulating spacer discs, each conductor disc having a narrow tip protruding outwardly from the shaft, the conductor discs being electrically connected such that current polarity alternates between adjacent conductor discs, and the tips of the conductor discs being pressed against the first and second ribbons.

Preferably, the method further comprises the steps of:

AA) positioning an electromagnet of step c) proximate to debris of the ribbon generated upon breakage of the ribbon between the first reel and the first mandrel;

BB) injecting current into the electromagnet of step c) to capture the debris;

CC) displacing the debris captured in step BB) to a disposal location; and

DD) releasing the debris at the disposal location by stopping the step of injecting current into the electromagnet of step c).

According to the present invention, there is also provided a system for transferring a ferromagnetic ribbon from a ferromagnetic ribbon roll mounted on a first reel to a first mandrel, comprising:

a first positioning system for positioning the first reel at a first unrolling position;

a first ribbon retention mechanism having retaining elements movable between a retaining position in which a free end of the ribbon roll is secured on the first reel and a releasing position in which the free end of the ribbon roll is free from the first reel;

a first electromagnet;

a controllable displacement system for displacing the first electromagnet along a path;

a first controllable current source for injecting current into said first electromagnet;

a first controller for controlling the controllable displacement system and the controllable current source to sequentially capture, displace and release the ribbon as said first electromagnet moves along said path;

a first controllable motor for rotating the first reel;

a first triggering system for triggering the retaining elements from the retaining position to the releasing position to free the free end of the ribbon;

a second controller for controlling the first triggering system, the first controllable current source and the first controllable motor, for simultaneously triggering the retaining elements from the retaining position to the releasing position as the first reel is rotating to free the free end of the ribbon as current is injected into the first electromagnet to capture the free end of the ribbon;

a second positioning system for positioning the first mandrel at a first rolling up position;

a second electromagnet located in said first mandrel;

a second controllable motor to rotate the first mandrel;

a second controllable current source for injecting a current into the second electromagnet;

a third controller for controlling the second controllable current source and the second controllable motor, to urge a free end of the ribbon roll as the first mandrel is rotating thereby rolling up the cuttable ferromagnetic ribbon roll on the first mandrel; and a cutter for cutting the ferromagnetic ribbon when a predetermined diameter of ferromagnetic ribbon rolled up on the first mandrel has been attained.

Preferably, the system further comprises a securing apparatus for securing a free end of the ferromagnetic ribbon rolled up on the mandrel, obtained after cutting by the cutter, onto the ribbon roll on the mandrel.

Preferably, according to one preferred embodiment, the securing apparatus comprises a second ribbon retention mechanism having retaining elements movable between a retaining position in which the free end of the ribbon roll on the mandrel is secured on the mandrel and a releasing position in which the free end of the ribbon roll on the mandrel is free from the mandrel.

Preferably, according to another preferred embodiment, the securing apparatus comprises a welder for welding the free end of the ribbon roll on the mandrel onto said ribbon roll on the mandrel.

Preferably, the system further comprises:

a second positioning system for positioning a second mandrel between a second rolling up position proximate to the path of the ribbon between the first reel and the first mandrel, and the first rolling up position;

a third electromagnet located in said second mandrel;

a third controllable motor to rotate the second mandrel;

a third controllable current source for injecting a current into the third electromagnet;

a fourth controller for controlling the third controllable current source and the third controllable motor, to urge a free end of the ribbon roll on the second mandrel as the second mandrel is rotating thereby rolling up the cuttable ferromagnetic ribbon roll on the second mandrel.

Preferably, the system further comprises:

a third positioning system for positioning a second reel having a second ribbon roll between a second unrolling position proximate to the path of the ribbon between the first reel and the first mandrel, and the first unrolling position;

a second ribbon retention mechanism having retaining elements movable between a retaining position in which the free end of the second ribbon roll is secured on the second reel and a releasing position in which the free end of the second ribbon roll is free from the second reel;

a fourth controllable motor for rotating the second reel;

a second triggering system for triggering the retaining elements from the retaining position to the releasing position to free the free end of the ribbon;

a fifth controller for controlling the second triggering system and the fourth controllable motor, for simultaneously triggering the retaining elements from the retaining position to the releasing position as the second reel is rotating to free the free end of the ribbon;

an attractor roller;

a fourth electromagnet located in said attractor roller;

a fifth controllable motor to rotate the attractor roller;

a fourth controllable current source for injecting current into the fourth electromagnet;

a rotating welder for welding the first and second ribbons together; and a sixth controller for controlling the fourth controllable current source, the fifth controllable motor, and the rotating welder, to urge the free end of the second ribbon and the first ribbon onto the attractor roller, and weld the first and second ribbons together.

Preferably, the rotating welder is mounted on a shaft and comprises a plurality of conductor discs separated by insulating spacer discs, each conductor disc having a narrow tip protruding outwardly from the shaft, the conductor discs being electrically connected such that current polarity alternates between adjacent conductor discs, and the tips of the conductor discs being pressed against the first and second ribbons.

BRIEF DESCRIPTION OF THE DRAWINGS

FIGS. 13 A to 13 C are schematic views showing sequencing events involved in the opening pivoting finger mechanisms, in order to release a free end of a ribbon on a roll, according to another preferred embodiment of the present invention.

PREFERRED EMBODIMENTS OF THE PRESENT INVENTION

Different preferred objects of the present invention will now be presented.

Accordingly, it is an object of the present invention to provide a method and apparatus in which the trailing free end of a ferromagnetic metal ribbon being unrolled from a first reel mandrel running out of material can be spliced with the leading free end a ribbon launched and unrolled from a second filled reel mandrel, in order to supply ribbon without interruption.

Accordingly, it is another object of the present invention to provide a method and apparatus in which a ferromagnetic metal ribbon being rolled-up in a roll can be cut once the roll is completed and the incoming free end of the cut ribbon will be engaged to start a new roll, in order to produce rolls in series without interrupting the incoming supply of ribbon.

Preferably, the ferromagnetic metal ribbon is rolled-up on reel mandrels in series.

Preferably, the ferromagnetic metal ribbon is rolled-up on core mandrels in series.

Preferably, the ferromagnetic metal ribbon is rolled-up on transformer kernel mandrels in series.

Figure 1:
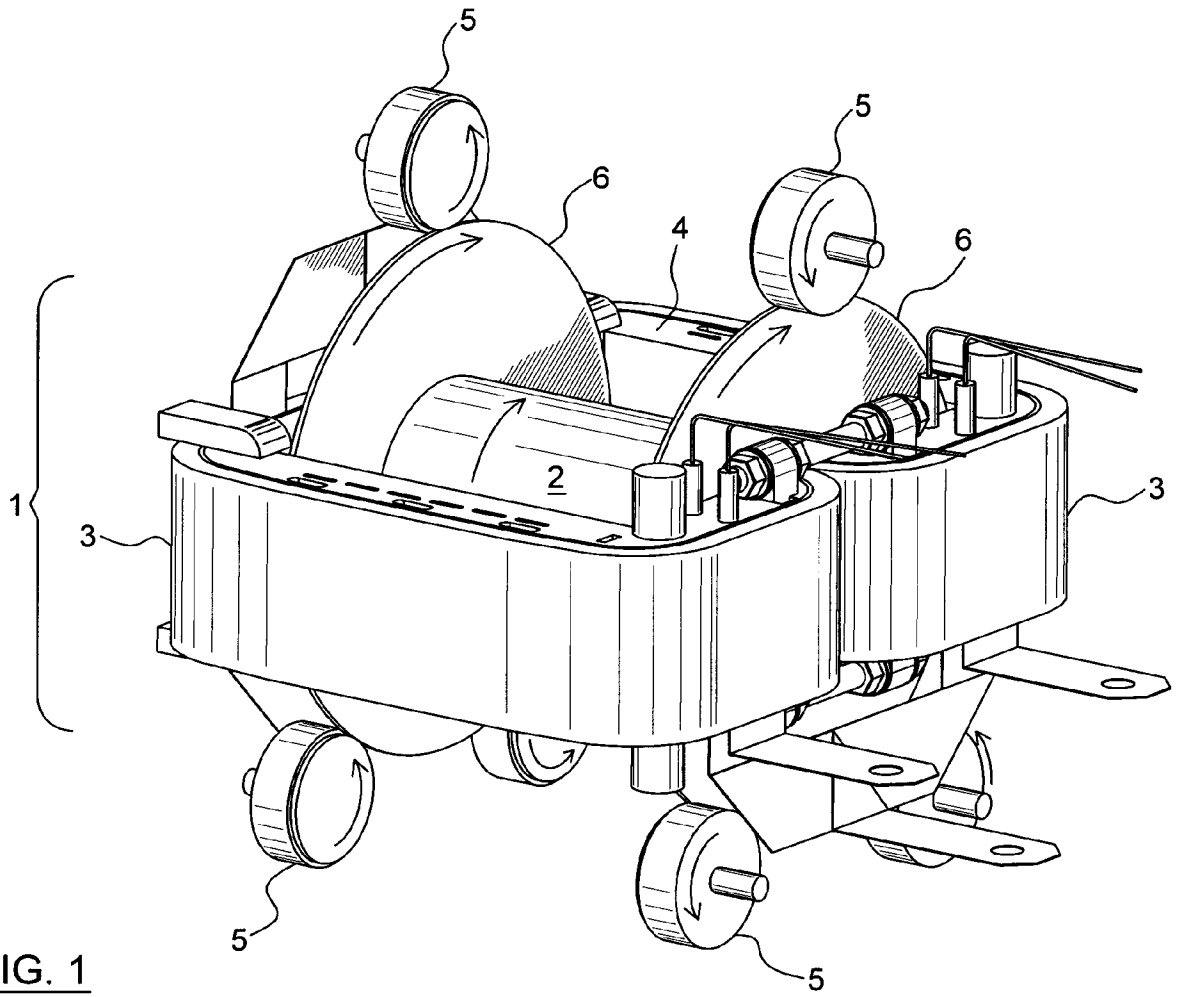
FIG. 1 is a perspective view of a transformer kernel without a ferromagnetic metal ribbon rolled up on the transformer kernel mandrel.

Referring to FIG. 1, there is shown a transformer kernel 1 having some similarities with the one disclosed in U.S. Pat. No. 5,566,443. This transformer kernel 1 is provided with a hollow mandrel 2 free to rotate around a central limb formed by electrical coils 3 assembled on a frame 4. The transformer kernel mandrel 2 is rotated by a number of drive rollers 5 urged and distributed against the outer periphery of two flanges 6 mounted at opposite ends of mandrel 2. The coils 3 and frame 4 are held still by means, not shown, in a position to avoid a frictional contact with the rotating mandrel 2. The drive rollers 5 each have one edge flush with the inner wall of the flanges 6. At least one of the drive rollers 5 is mechanically linked to a shaft of a servo motor, not shown. A ferromagnetic ribbon engaged on the transformer kernel mandrel 2 is then rolled-up to form a magnetic core by rotating the mandrel 2 using at least one of the motorized drive rollers 5 on the flanges 6.

Figure 2:
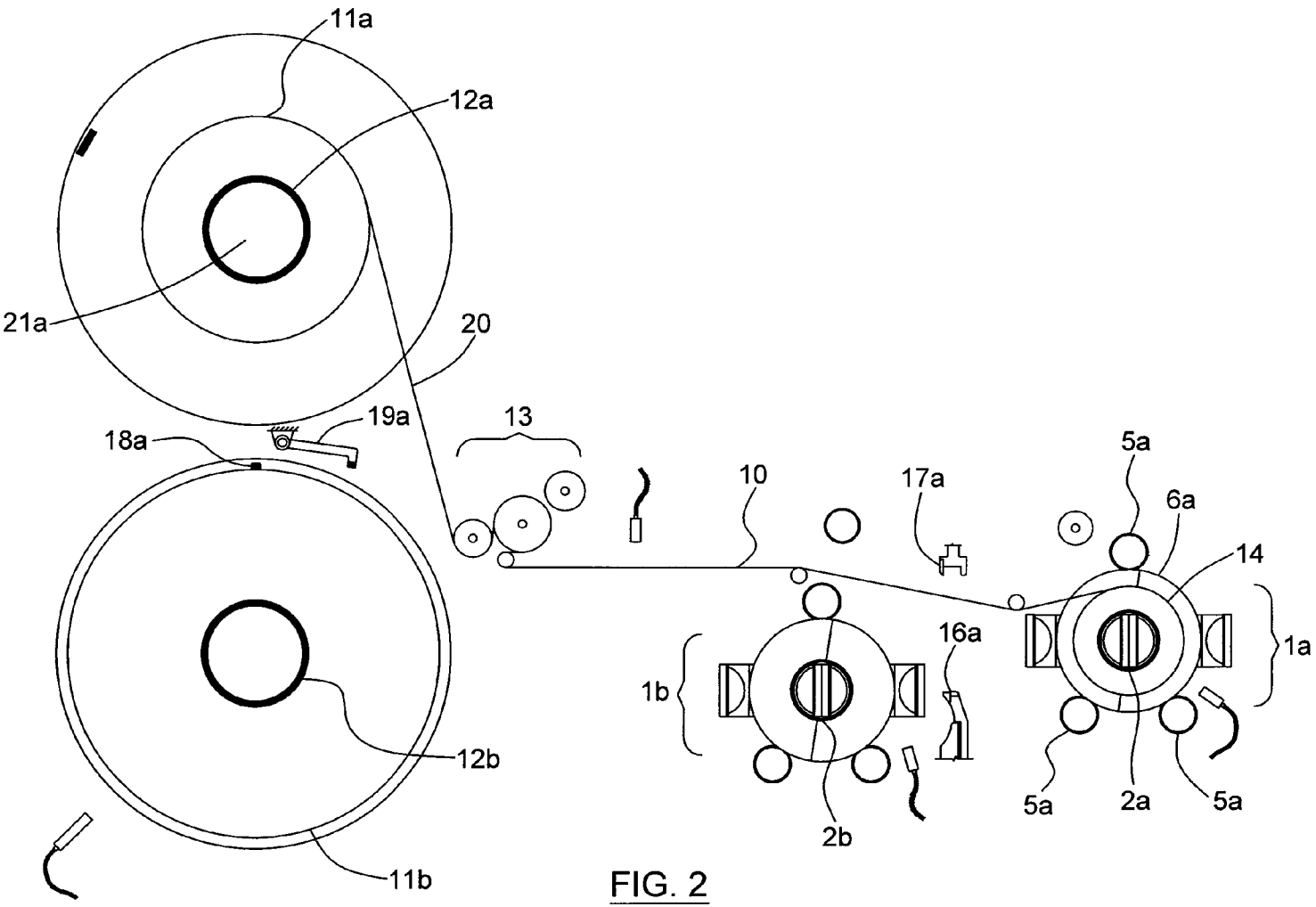
FIG. 2 is a schematic view of an automated system for rolling up a ferromagnetic metal ribbon on transformer kernel mandrels in series according to a preferred embodiment of the present invention.

Referring to FIG. 2, there are shown main parts of an automated system for rolling up a ferromagnetic metal ribbon on transformer kernel mandrels in series. A ribbon 10 supplied from a roll 11*a* supported on a reel mandrel 12*a* is passed through a ribbon splicer 13 and is then rolled up on a rotating transformer kernel mandrel 2*a* to form a roll 14 which will become the core of a transformer kernel 1*a*. When the roll 14 on the rotating mandrel 2*a* is completed, the system actuates shear cutting blades 16*a* and 17*a* to cut the transferring ribbon 10 and activates a mechanism to wrap the leading free end of the cut ribbon on an empty transformer kernel rotating mandrel 2*b*, in order to roll up a new core for a transformer kernel 1*b*. The system also comprises a standby rotating reel mandrel 12*b* filled with a roll 11*b* which will take the relay in supplying the ribbon 10 once the reel mandrel 12*a* runs out of ribbon. The ribbon free end on the outer surface of roll 11*b* is held against the roll by a securing device 18*a* mounted on the reel flanges and, at the proper moment, is released by a swinging lever 19*a*, in order to be launched towards the ribbon splicer 13 where it will be spliced on a trailing portion 20 of the ribbon outgoing from reel mandrel 12*a*.

In the shown apparatus, the ribbon 10 is transferred at a specific speed and is under a specific tensile stress. The ribbon transfer speed is controlled by setting either rotating speed of reel mandrel 12*a* via a motorized spindle 21*a*, or the rotating speed of transformer kernel mandrel 2*a* via motorized drive rollers 5*a* urged against the transformer kernel mandrel flanges 6*a*. The ribbon tensile stress is then adjusted by setting the rotating torque of the mandrel located at the opposite end of the transferring ribbon. Since a filled reel mandrel normally contains enough ribbon to roll up cores for multiple transformer kernels, it therefore has a bigger mass than the cores it produces. In this case, it is preferable to control the ribbon transfer speed by setting the rotating speed of reel mandrel 12*a* and, to control the ribbon tensile stress by setting the rotating torque of transformer kernel mandrel 2*a*. However, as the mass of the roll 14 gets bigger on mandrel 2*a*, it may become difficult to control the tensile stress in the ribbon when the ribbon transfer is achieved between the two large rotating masses.

Figure 3:
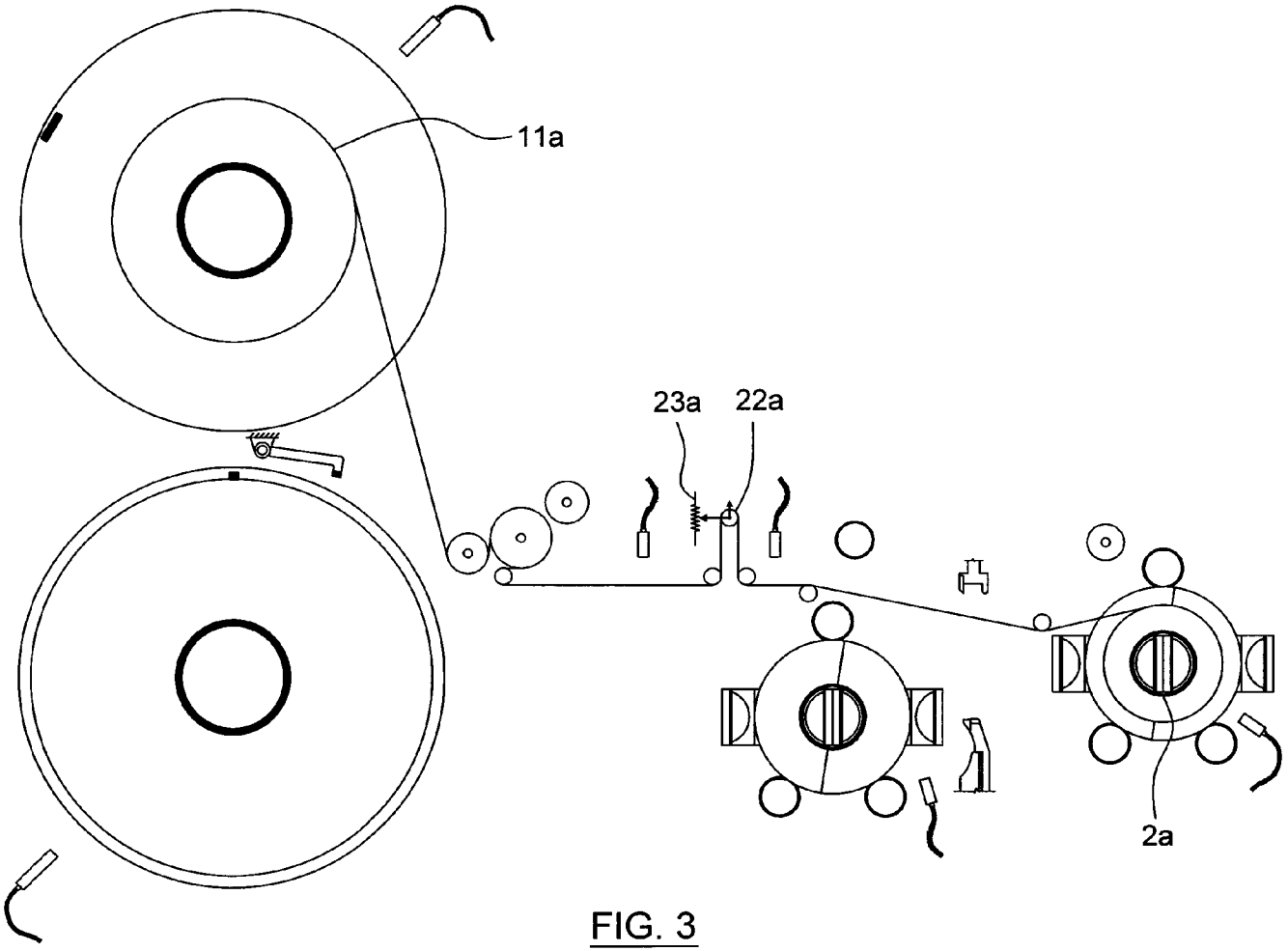
FIG. 3 is a schematic view of automated system for rolling up a ferromagnetic metal ribbon on transformer kernel mandrels in series according to another preferred embodiment of the present invention.

Referring to FIG. 3, a tensioning roller 22*a* free to move vertically between two guiding rollers is added to pull on the ribbon with a set force. The vertical position of tensioning roller 22*a* is used to set the rotating speed of mandrel 2*a*, in order to synchronize the rolling speed with the feeding rate of the ribbon supplied by the roll 11*a*. The tensile stress is then easily controlled by the set pulling force on roller 22*a* which has a small mass. With the setup of FIG. 3, the unrolling and rolling-up tensile stresses are the same.

Figure 4:
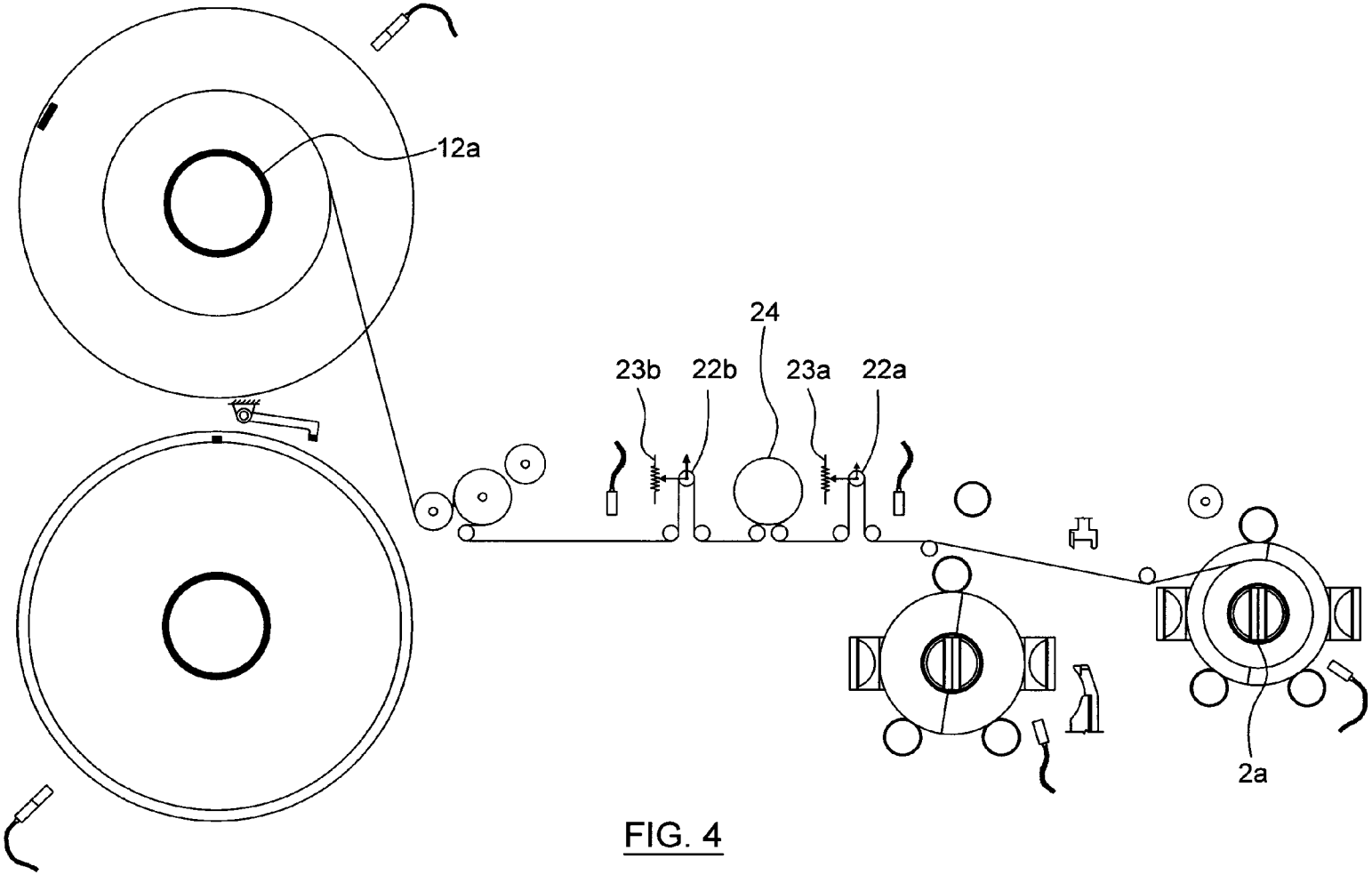
FIG. 4 is a schematic view of an automated system for rolling up a ferromagnetic metal ribbon on transformer kernel mandrels in series according to another preferred embodiment of the present invention.

Referring now to FIG. 4, if different unrolling and rolling-up tensile stresses are required, a second tensioning roller 22*b* with a position sensor 23*b* can be added upstream and separated from tensioning roller 22*a* by a capstan motorized drive roller 24, which is used to drive and set the ribbon transferring speed. The tensioning roller 22*b* with the position sensor 23*b* are then used to set the unrolling tensile stress and the rotating speed of reel mandrel 12*a* and, the tensioning roller 22*a* with the position sensor 23*a* are used by the controller to set the rolling up tensile stress and the rotating speed of transformer kernel mandrel 2*a*.

Figure 5:
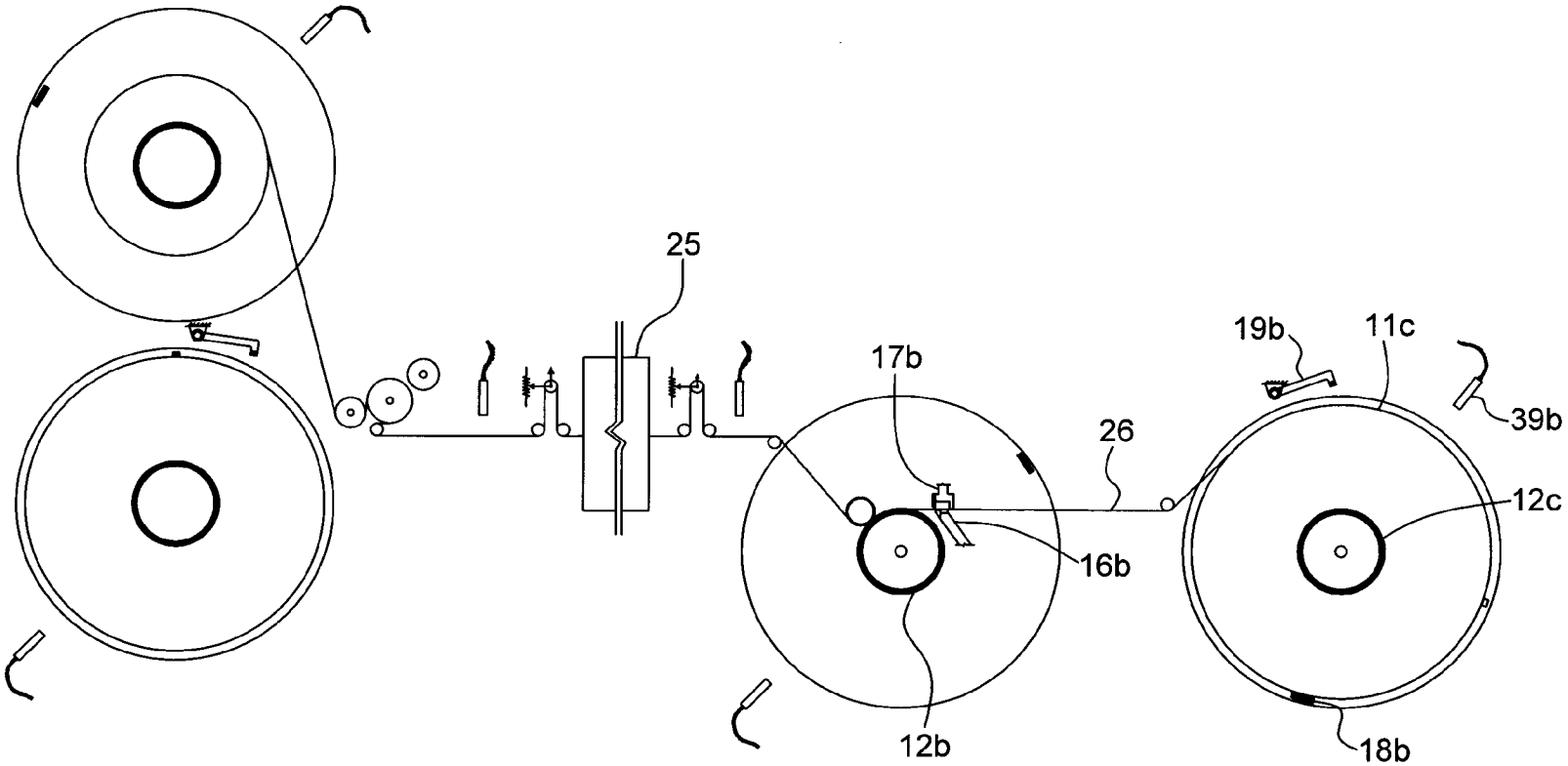
FIG. 5 is a schematic view of an automated system for rolling up a ferromagnetic metal ribbon on reel mandrels in series according to another preferred embodiment of the present invention.

In addition to illustrating rolling up cores of transformer kernels in series, FIG. 5 also shows a system comprising means for rolling up rolls of ribbon on reel mandrels in series. Such an apparatus can be installed at the output of a ribbon casting process or, at the output of a in-line ribbon annealing process 25. In this system, a transferring ribbon 26 is being rolled up to form a roll 11*c* on a reel mandrel 12*c* which also comprises a ribbon securing device 18*b*. The securing device 18*b* is engaged by a swinging lever 19*b* to secure the free end of the trailing ribbon on roll 11*c* after it has been cut by the shear blades 16*b* and 17*b* upon completion of roll 11*c*. At the same time, the leading end of the cut ribbon is switched onto an empty reel mandrel 12*d* without interrupting the ribbon transfer. The in-line ribbon annealing process 25 is also continuously supplied with a ribbon unrolled alternately from rolls using the automated splicing system described hereinabove.

Figure 6:
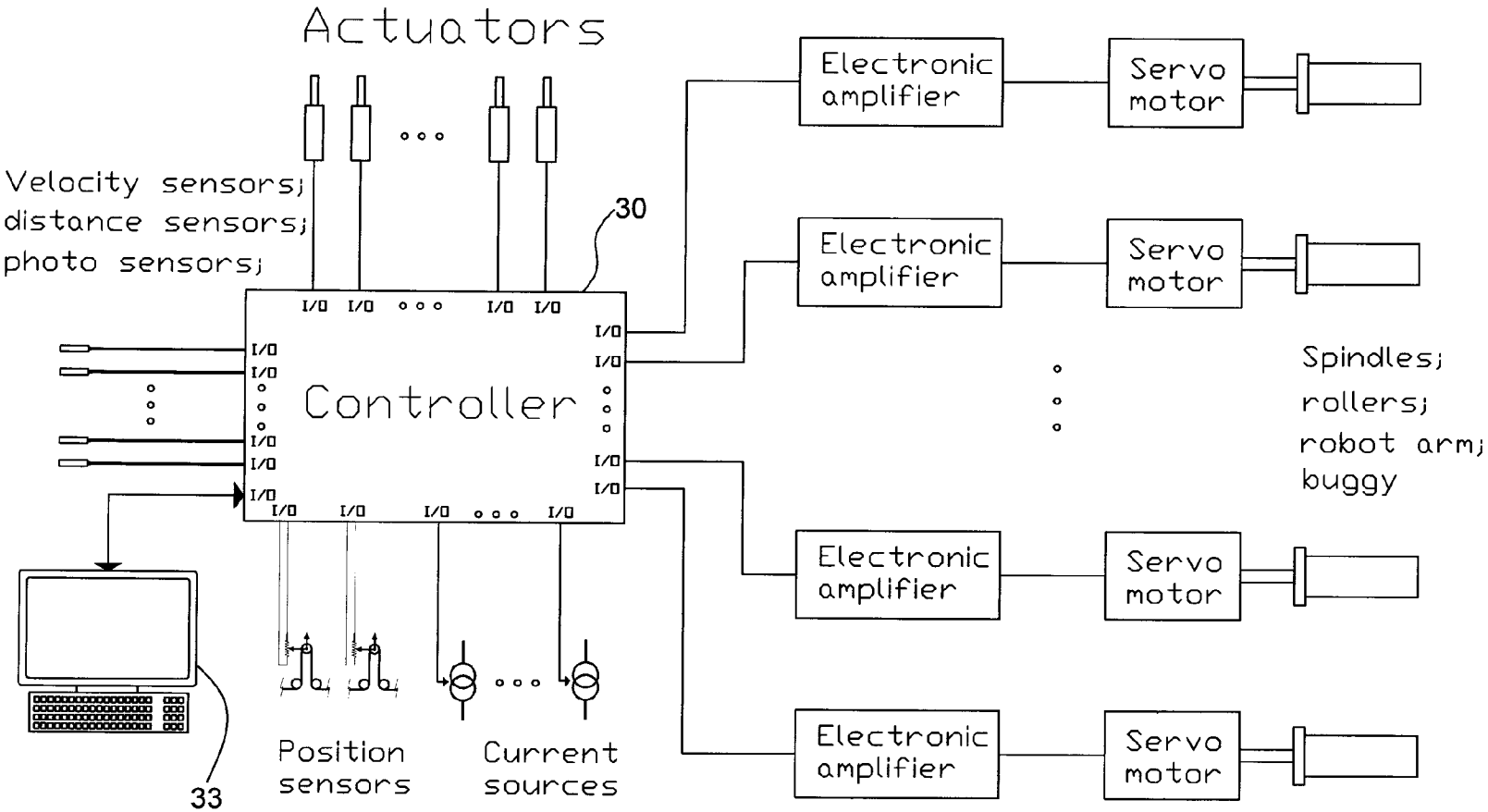
FIG. 6 is a schematic view of a control system and controlled elements, according to another preferred embodiment of the present invention.

Referring now to FIG. 6, there is shown a schematic drawing of a control system. A controller 30 which comprises a CPU and a memory bank is connected to peripheral elements via I/O ports, in order to receive information status or to send instructions to the elements. The peripheral elements include electronic amplifiers connected to servo motors to control their rotating torque or speed, each servo motor driving via a shaft a spindle, a roller, a robot arm, a buggy or any motorized rotating device in the automated systems disclosed in the present invention. The peripheral elements further include actuators to be controlled by the controller 30. These actuators are used at different locations in the disclosed automated systems, such as for activating a swinging lever or the cutting blades. Actuators are also used to control the position of: spindles holding the reel mandrels; holding means holding the transformer kernel coils-frames; drive rollers holding the transformer kernel mandrels; and all other controllable movable parts disclosed in the present invention. The peripheral elements further include velocity, distance, position and photo sensors from which the controller can read their measured parameters or status. Sensors are used in the present invention to measure the state of the process. The peripheral elements further include controllable current sources which are used to control electromagnets and welders in the present invention. The controller 30 is programmed via a user interface 33. The peripheral elements may include auxiliary controllers to perform local tasks. The running control program, loaded in controller 30 memory, is run by the controller 30 CPU to control the operation of the automated systems for rolling up a ferromagnetic metal ribbon on transformer kernel or reel mandrels in series.

Figure 7:
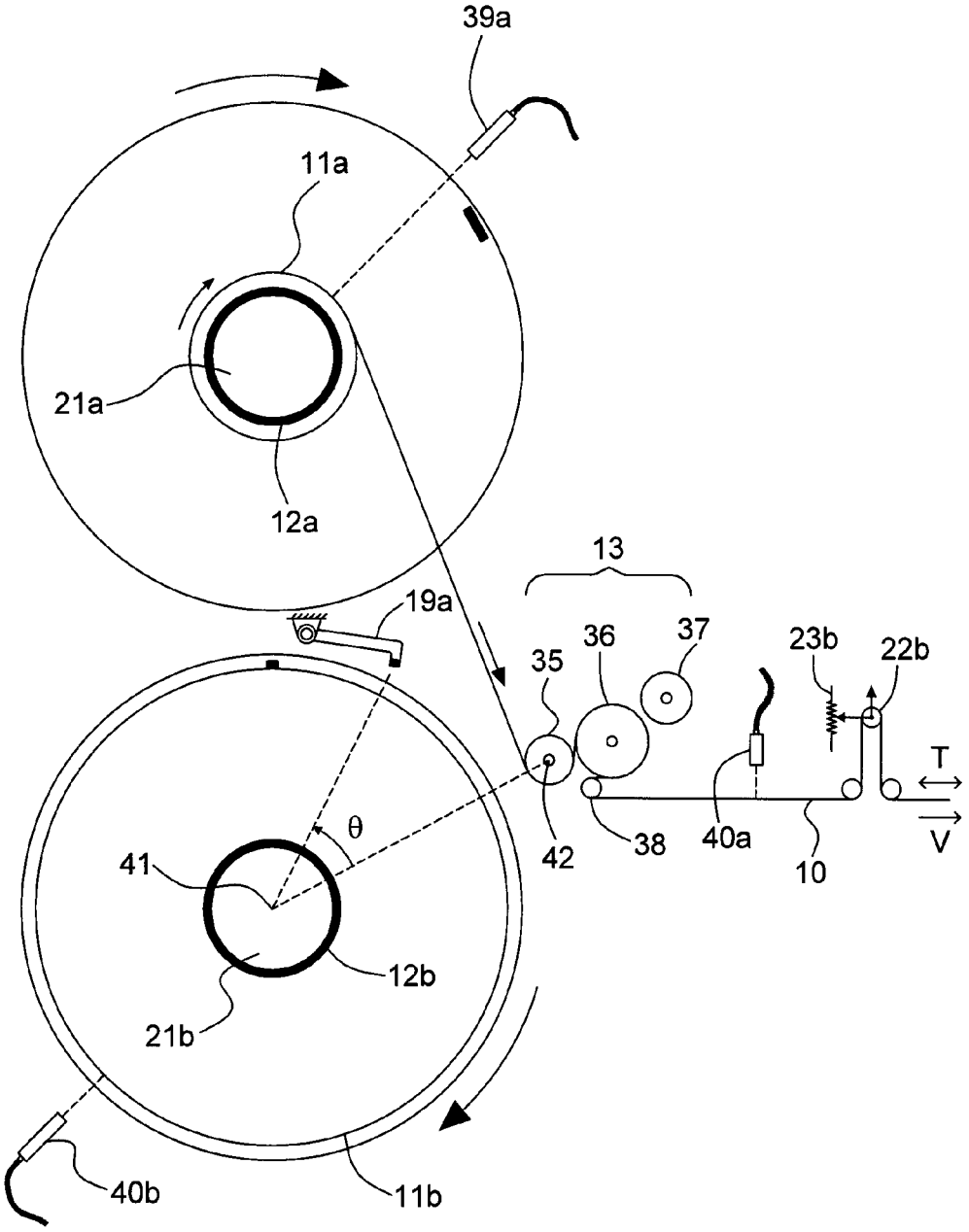
FIGS. 7 to 10 are schematic views of sequencing events involved to perform an automatic ribbon splicing when a ribbon is fed from a roll which is running out of ribbon, according to another preferred embodiment of the present invention.

FIGS. 7 to 10 show detailed sequencing events involved in performing automatic ribbon splicing when a ribbon is fed from a roll which is running out of ribbon. Referring first to FIG. 7, the roll 11*a* on the reel mandrel 12*a*, which is mounted on the motorised spindle 21*a*, is unrolled at a rotating speed set by the controller 30 using the tensioning roller 22*b* and the position sensor 23*b* to supply a ribbon 10 at a given transfer speed V and tensile stress T. The unrolled ribbon 10 snakes trough the ribbon splicer 13 comprising an attracting roller 35, a conductive roller 36, a welding roller 37 and a guide roller 38. A precise distance sensor 39*a*, such as a laser distance sensor, is aimed at the outer surface of roll 11*a* to measure its distance which is then sent to the controller 30 where the roll thickness on the reel mandrel 12*a* is continuously computed. The reel mandrel 12*b* filled with the roll 11*b* is loaded on a motorised spindle 21*b* and is adjusted on the spindle to align both sides of roll 11*b* with the sides of roll 11*a*. A surface velocity sensor 40*a*, such as a laser surface velocity meter, is aimed at the surface of the transferring ribbon 10 located downstream to the ribbon splicer 13 to continuously monitor the ribbon transferring speed which is then sent to the controller 30. A surface velocity sensor 40*b* is aimed at the outer surface of roll 11*b* to continuously monitor its outer surface rotating speed which is also sent to the controller 30. Before the reel mandrel 12*a* becomes empty, the reel mandrel 12*b* is brought into rotation and its rotating speed is set by the controller 30 in order to null the gap computed between the surfaces speeds received from the two velocity sensors 40*a* and 40*b*. The swinging lever 19*a* is located at a predetermined angle θ near the outer periphery of roll 11*b* with reference to a straight line extending from the rotating axis 41 of reel mandrel 12*b* to the rotating axis 42 of attracting roller 35.

Figure 8:
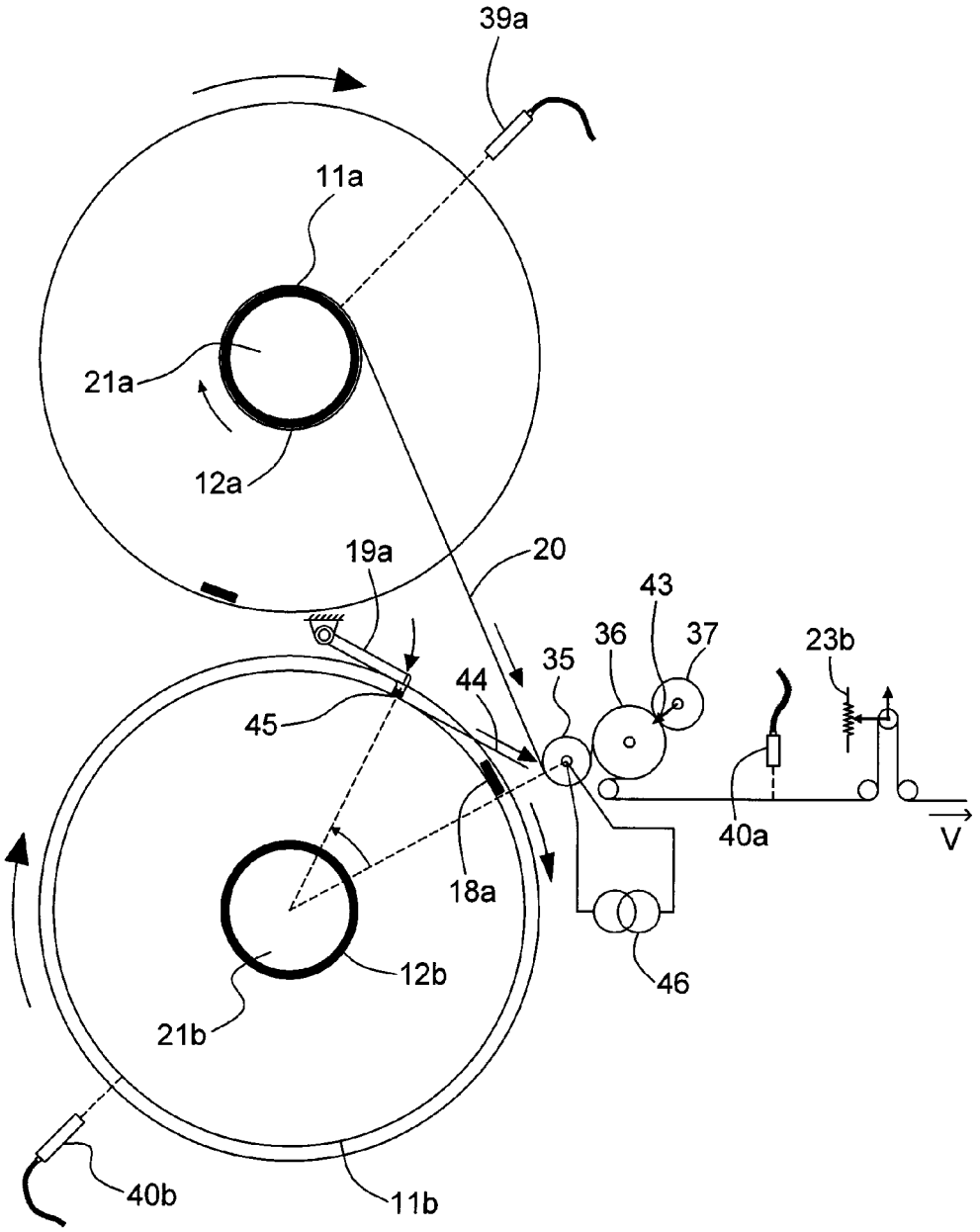

Referring then to FIG. 8, the thickness of roll 11*a* on reel mandrel 12*a* has reduced to a size where a splicing sequence must now be initiated as determined by the controller 30 using the distance sensor 39*a*. Therefore, the controller 30 sends an instruction to an actuator linked to the welding roller 37, in order to press the welding roller against the ribbon passing on the conductive roller 36 at point location 43 and, the controller 30 sends an instruction to an actuator linked to the swinging lever 19*a*, in order to actuate the swinging lever 19*a* in between two passes of the securing device 18*a*. The position of the securing device is known to the controller 30 by using for example a photo sensor. When the securing device 18*a* crosses the swinging lever 19*a*, it is forced to open by pushing pins mounted on the swinging lever 19*a*, in order to release the ribbon free end 44 on the roll 11*b*. By action of the centrifugal force and of the pressure exerted by the stagnant air surrounding the roll's surface, the ribbon free end 44 is peeled off and is catapulted by acquired momentum in a direction tangential with the roll's outer surface from a launching point 45 close the releasing angle θ. The angle θ is adjusted to align the trajectory of the ribbon leading end 44 with the outer surface of attracting roller 35. At the same instant, the controller 30 sends an instruction to a current source 46 which will inject a current impulse in an electromagnet located within an hollow portion of attracting roller 35, in order to produce a magnetic field which will attract the incoming ferromagnetic metal ribbon leading end 44 to stick over the ribbon trailing portion 20 unrolling from roll 11*a*, until the ribbon free end 44 gets guided and trapped under the ribbon trailing portion 20 on the conductive roller 36. At this instant, the controller 30 cuts the rotating speed regulation of reel mandrel 12*a* with the feedback position sensor 23*b* and only maintains a low counterclockwise torque on the motorized spindle 21*a* and, switches the rotating speed regulation feedback of reel mandrel 12*b* using the motorized spindle 21*b* from the velocity sensors 40*a* and 40*b* to the position sensor 23*b*.

Figure 9:
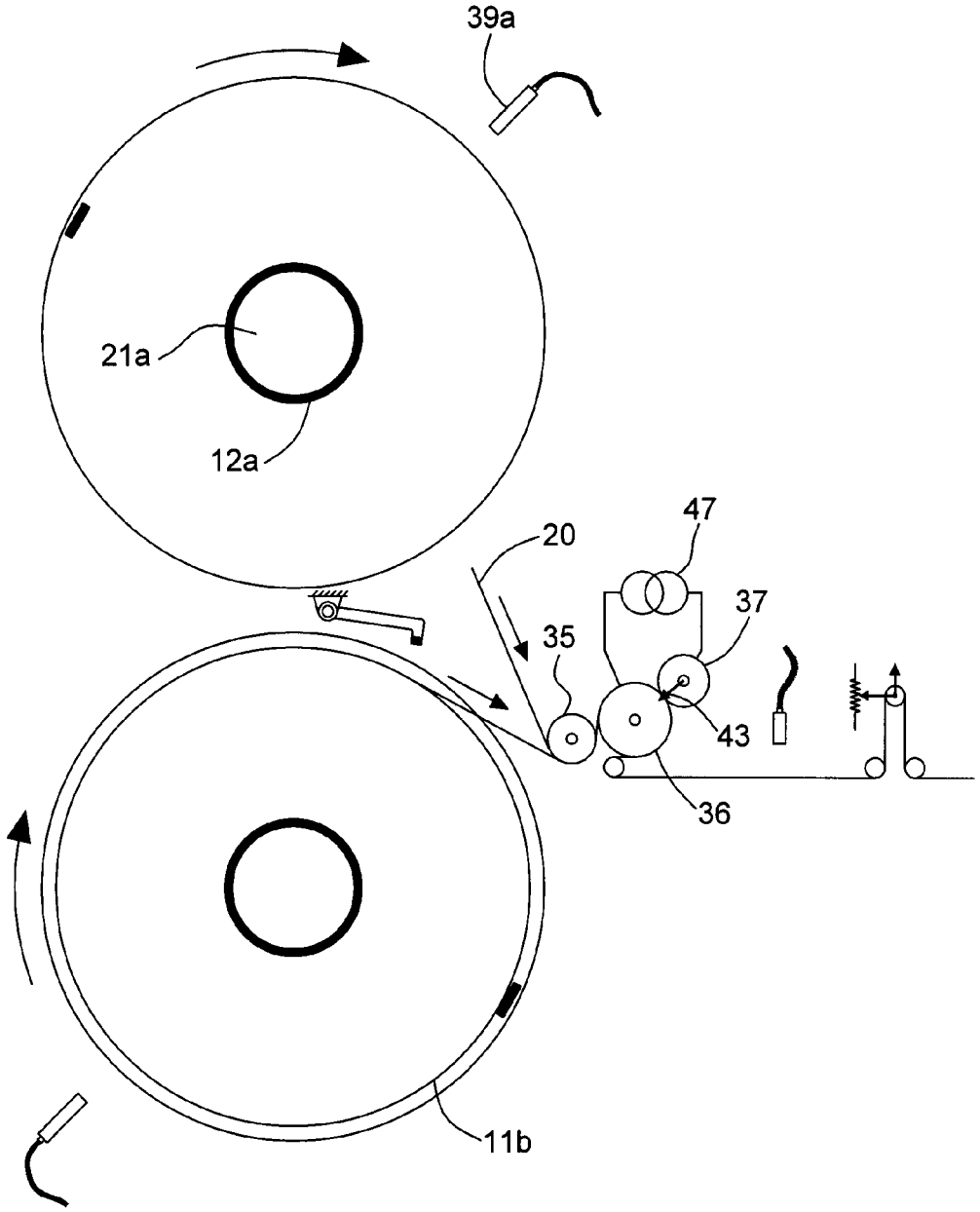

Referring then to FIG. 9, the controller 30 sends an instruction to a current source 47 which will inject a welding current between the welding roller 37 and the conductive roller 36, in order to bind both stacked ribbons. The welding current is maintained until the trailing end of ribbon portion 20 reaches the welding point 43. This occurrence can be anticipated by the controller 30 using a photo detector, not shown, located upstream to the attractive roller 35 and aimed on the ribbon trailing portion 20, or built in the distance sensor 39*a*, to detect the instant when the end of the ribbon trailing portion 20 will pass. Then, the rotation of reel mandrel 12*a* is stopped following an instruction sent by the controller 30 to the motorized spindle 21*a*.

Figure 10:
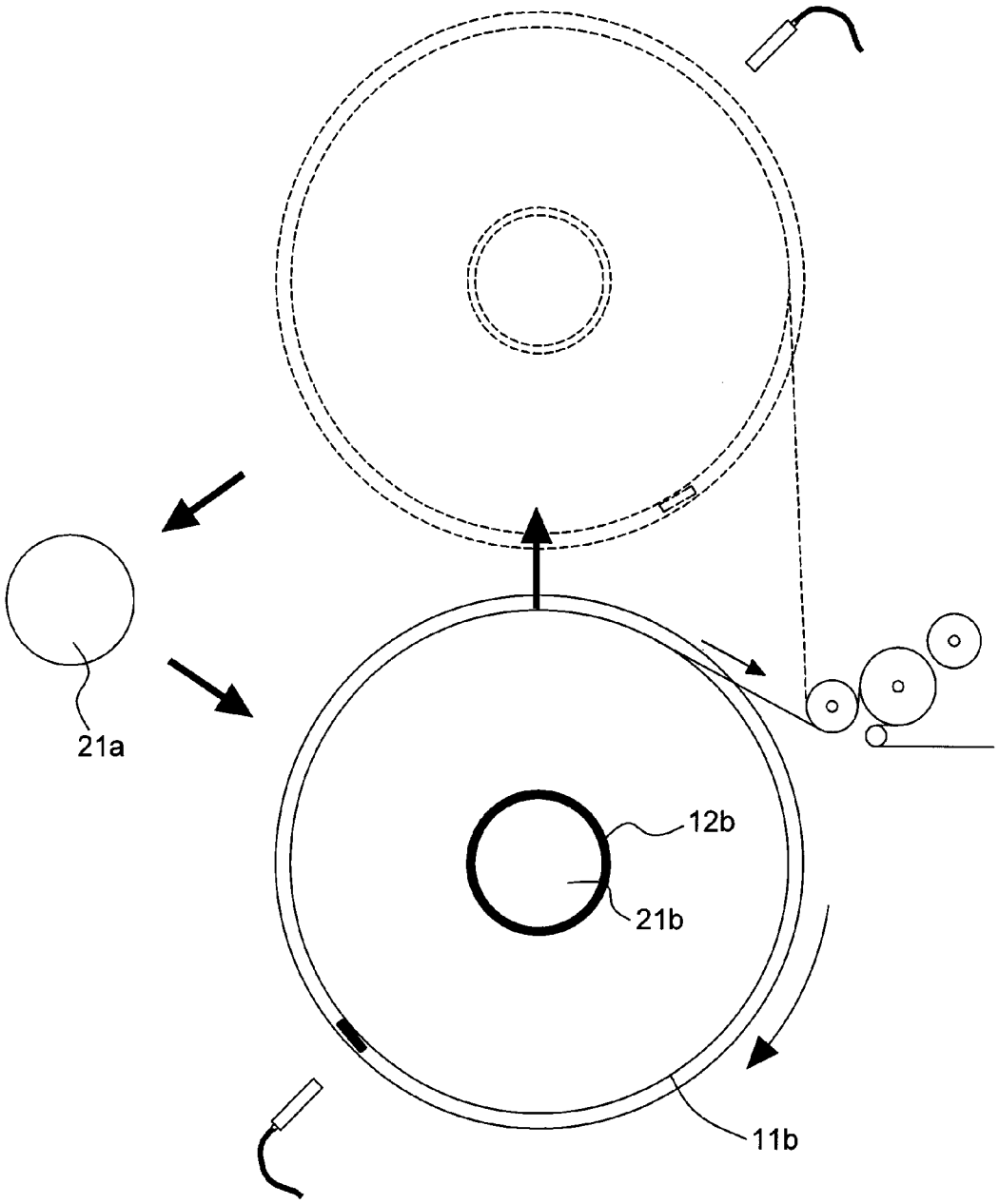

Referring finally to FIG. 10, after the splicing is completed, the empty reel mandrel 12*a* is removed from spindle 21*a* and the spindle positions are switched. The controller 30 sends instructions to actuators linked to each spindle 21*a* and 21*b*. The spindle 21*a* position is moved to the left to allow the spindle 21*b* position to move up while the rotation of reel mandrel 12*b* is maintained and then, the spindle 21*a* position is brought down to the place previously occupied by spindle 21*b*. While the roll 11*b* is being unrolled, a new reel mandrel filled with a roll of ribbon is loaded on spindle 21*a*, in order to be prepared for the next splicing sequence. Therefore, a continuous feeding of a ribbon in the present apparatus is provided.

Figure 11A:
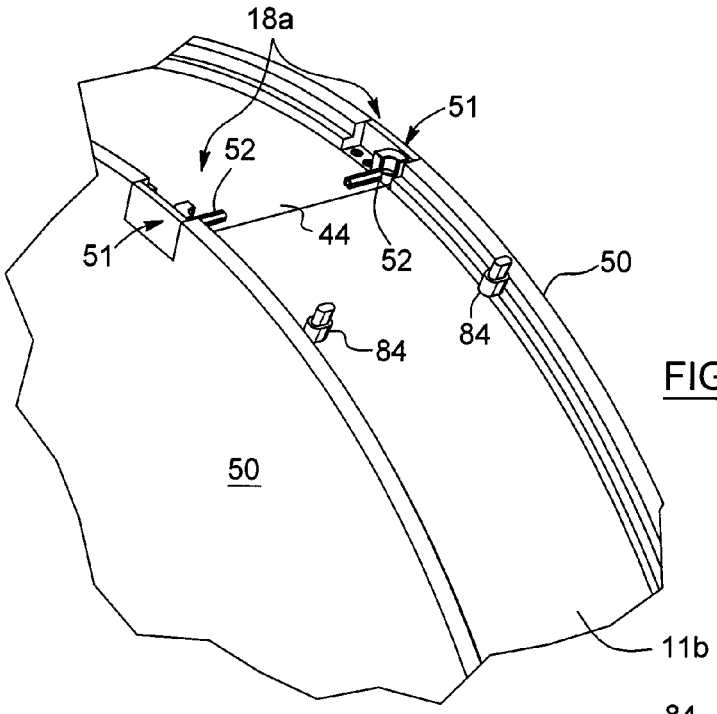
FIG. 11A to 11C are schematic views showing a securing device mounted on reel flanges and used to secure a free end of a ribbon on a roll according to another preferred embodiment of the present invention.
Figure 11C:
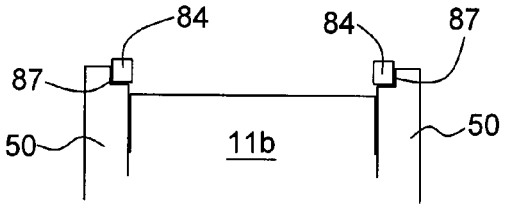
Figure 11B:
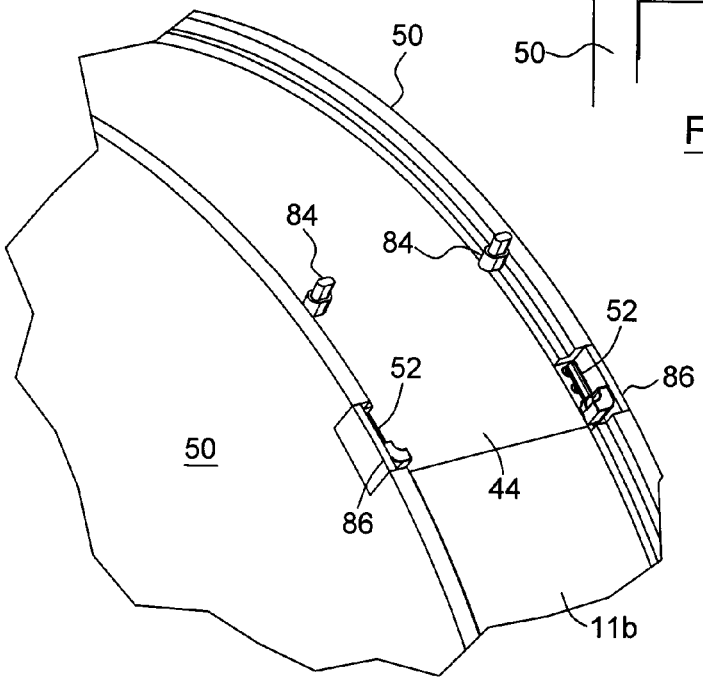

A detailed construction and operation of a ribbon securing device 18*a* is shown in FIGS. 11 to 13. Referring to FIGS. 11A and 11B, detailed portions of a reel mandrel provided with side flanges 50 and containing a ribbon roll 11*b* are shown. The ribbon securing device 18*a* comprises two pivoting finger mechanisms 51 respectively embedded, facing each other, in the outer periphery of the reel flanges 50, for securing or releasing the ribbon free end 44 on the surface of roll 11*b*. In FIG. 11A, two pivoting fingers 52 are closed and are securing the ribbon free end 44. In FIG. 11B, the two pivoting fingers 52 are opened and the ribbon free end 44 is released. When the pivoting fingers 52 are opened, they are embedded in the wall of reel flanges 50, in order to clear the way for the ribbon to roll-up on or to unroll from the roll 11*b*.

Figures 12A, 12B, 12C, 12D, 12E, 12F, 12G:
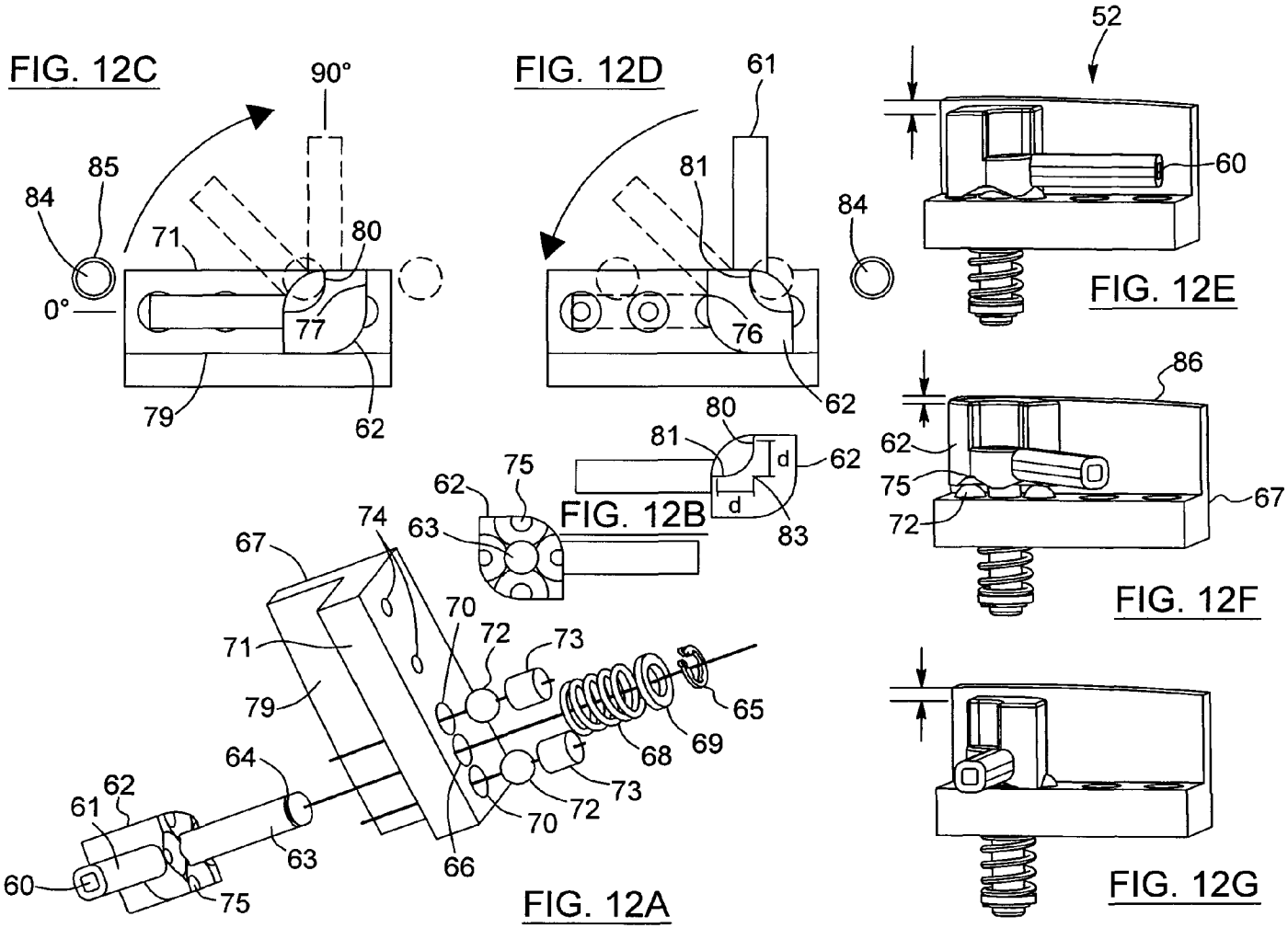
FIG. 12A to 12G include an exploded view, a pair of top and bottom views, another pair of top views and three perspective views respectively showing the detailed construction of a pivoting finger mechanism included in a securing device according to another preferred embodiment of the present invention.

Referring now to FIG. 12A, a finger 60 covered with resilient material 61 is perpendicularly linked to the side of a barrel 62. The finger 60 is sufficiently long to provide enough contact for holding the ribbon free end 44 when extending over the roll 11*b* as shown in FIG. 11A. Referring back to FIG. 12A, the barrel 62 has a shaft 63 extending on one side and which is provided with a small slot 64 near the tip for receiving a snap ring 65. The shaft 63 will pass through a hole 66 in a supporting frame 67 to extend beyond on the other side, in order to slide-on a coil spring 68 and a compressing washer 69 which will both be held in place by the snap ring 65. The support frame 67 further has two openings 70 on opposite sides of hole 66, with all three holes being aligned in parallel with the edge 71 of the supporting frame 67. Each of the openings 70 is for receiving a lubricated rolling ball 72 to be secured-in by a plug 73 from the underside of the supporting frame 67. Preferably, each plug 73 has a spherical recess to fit on the rolling ball 72. Also, each of the openings 70 on the top side of the supporting frame 67 is made slightly narrower near the surface so that the rolling ball 72 will bulge out from the surface without escaping. The supporting frame 67 also has holes 74 for inserting securing screws, in order to secure the assembly to the reel flange 50. Referring to FIG. 12B, the underside portion of the barrel 62 has four recesses 75 equally distributed around the shaft 63. When the pivoting finger mechanism is assembled, the spring 68 is compressed and pulls the barrel 62 to lean on the bulging rolling balls 72 and thus, providing with the recesses 75 ninety degrees angular stable positions for the barrel 62 on the supporting frame 67. Referring to FIGS. 12C and 12D, the barrel 62 has two perpendicular flat portions 76 and 77 working with an upright wall 79 provided on the supporting frame 67 to limit the pivoting span angle to ninety degrees, and thus providing only two ninety degrees stable angle positions for the barrel: one stable position with the finger 60 extending out perpendicularly from the supporting base edge 71 when set in closed position and, one stable position with the finger 60 aligned on the support base when set in opened position. Going back to FIG. 12B, the rotation of the barrel is achieved by pushing on a lever. The top portion of the barrel 62 comprises two wall portions 80 and 81 for providing a lever when a force is perpendicularly applied at a distance d from the pivoting axis 83 of the barrel. In FIG. 12C, when the pivoting finger is opened, a pushing pin 84 moving sideways from left to right and hitting the wall portion 80 will flick the pivoting finger clockwise to a closed position and in FIG. 12D, when closed, the same pushing pin 84 moving sideways from right to left and hitting the wall portion 81 will flick the pivoting finger counterclockwise to an opened position. As it can be seen in FIGS. 12C and 12D, the only part protruding beyond the supporting base edge 71 is the finger 60 when set in a closed position. Preferably, the pushing pin 84 is surrounded with a layer 85 of rubber-like material to soften the impact force when the pin hits the lever.

FIGS. 12E to 12G show the rotation of the pivoting finger 52 from a perspective view. During rotation, the pivoting finger 52 is subjected to an axial displacement imposed by the bulging balls 72 rolling on the underneath side of the barrel 62 in between recesses 75. While pivoting, the finger initially makes an upward movement with the bulging balls 72 rolling out of the recesses 75, to reach a highest point in FIG. 12F and then, the finger moves downwards as the bulging balls 72 are engaging in the next corresponding recesses 75. This upward movement of the barrel 62 allows the finger 60 to clear the roll 11*b* outer edge before going downwards, in order to make contact with the roll 11*b* surface. The finger 60 can have permanent magnet properties to force the ribbon end to peel off from the roll when they are opening. The resilient material 61 covering the finger 60 will slightly deform on contact with the surface of roll 11*b* under the pressuring force exerted by the compressed spring 68. Preferably, the pivoting finger remains at a higher distance from the supporting frame 67 when set in an open position as shown in FIG. 12E.

Going back to FIGS. 11A and 11B, the upright wall 86 of the supporting frame 67 is profiled to match with the outer circular edge of the reel flange 50. The ribbon is rolled up until the roll 11*b* increasing diameter becomes large enough for allowing the closing of the pivoting fingers 52, in order to apply enough pressure on the roll with the fingers to retain the ribbon free end 44. Referring also to FIG. 11C, each flange 50 has a notch 87 on the inside edge to clear a passage for lowering the pushing pins 84 between two passes of the pivoting fingers while the reel is rotating, in order to flick the levers on both barrels at the next pass, after which the pins 84 are quickly pulled up. In FIG. 11A, the reel has to rotate clockwise to open the closed pivoting fingers 52 with the pushing pins 84. In FIG. 11B, the reel has to rotate counterclockwise to close the opened pivoting fingers 52 with the pushing pins 84.

FIGS. 13A to 13C show sequencing events for releasing the ribbon free end 44 from the roll 11*b*. In FIG. 13A, the reel is rotating clockwise with the pivoting fingers 52 closed. The two pushing pins 84 are mounted on the swinging lever 19*a* which also comprises a pivoting shaft 88. The swinging lever 19*a* is swung by the actuator, not shown, around the axis 89 of the pivoting shaft 88 to engage the pushing pins 84 in the notches 87, in order to collide with the incoming pivoting fingers 52. Next in FIG. 13B, the pushing pins 84 are pushing against the pivoting fingers 52 to release the ribbon free end 44 from roll 11*b*. Next in FIG. 13C, the pivoting fingers 52 are completely opened and the ribbon free end 44 is released and catapulted. The events shown can be sequenced backwards from FIGS. 13C to 13A with the reel rotating counterclockwise to explain how the trailing end 44 of a ribbon being rolled-up on roll 11*b* can be secured just after the incoming ribbon has been cut. The location of the cut on the ribbon is determined by the controller 30 in relation to the position of the pivoting fingers during the rotation of the reel to ensure that the fingers will pinch the ribbon free end 44 as shown in FIG. 13A.

Figure 14:
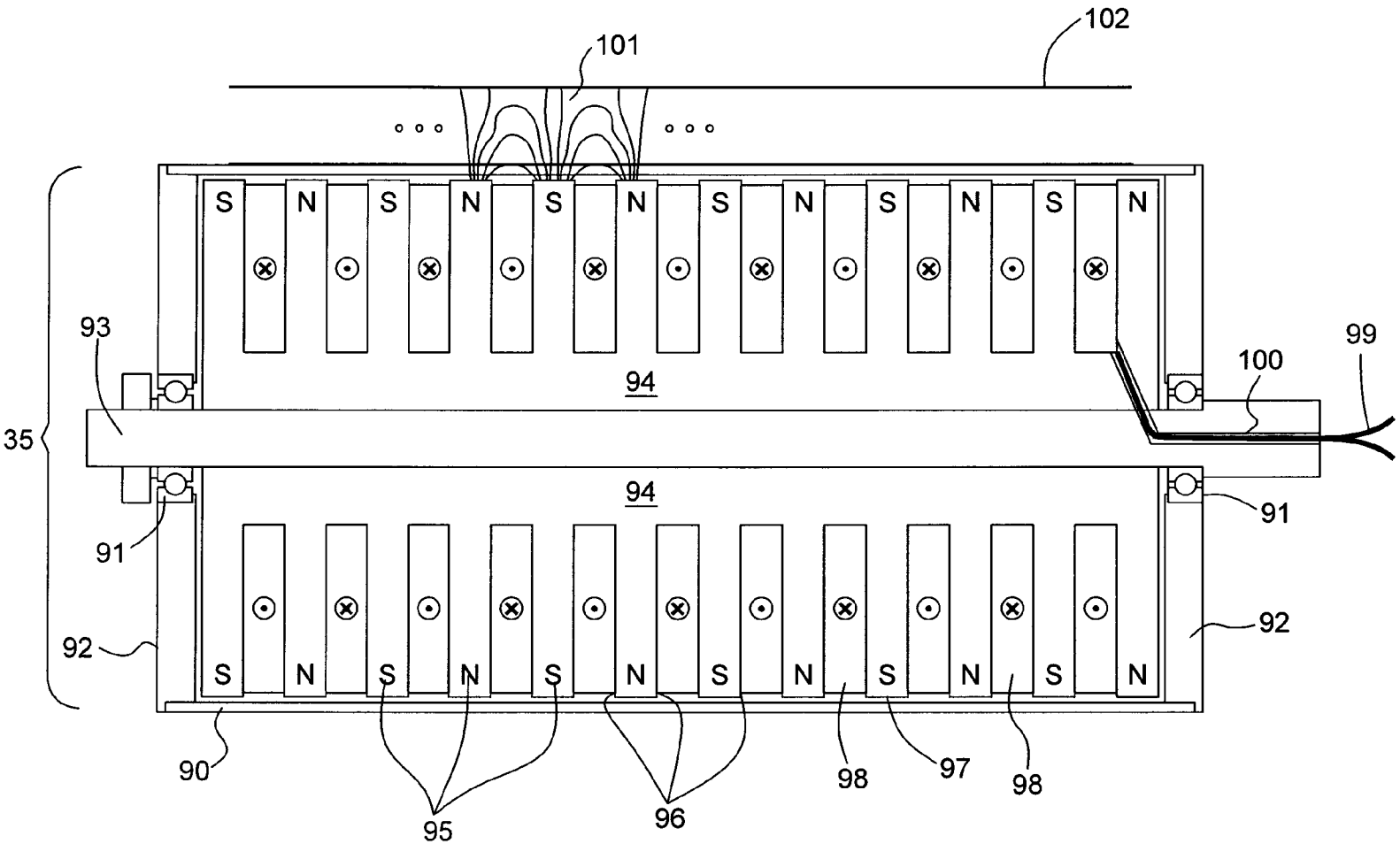
FIG. 14 is a cut view of a roller comprising an electromagnet for attracting a ferromagnetic metal ribbon according to another preferred embodiment of the present invention.

FIG. 14 shows an axial cut view of the attracting roller 35. It comprises a non-ferromagnetic cylinder 90 mounted with bearings 91 and flanges 92 on a shaft 93 to form a roller. Inside the hollow portion of the formed roller, a ferromagnetic yoke 94 is mounted on the shaft 93 and is provided with teeth 95 forming a series of discs separated by slots 96 and protruding outwardly towards the underneath surface of cylinder 90 and being separated from said surface by a small gap 97. Each slot comprises several turns of a conductor coiled around the shaft axis to form a conductive coil 98. All the conductive coils 98 are electrically interconnected, preferably in series, via passageways in the yoke (not shown) and linked to a pair of conductor leads 99 exiting outside of the roller through an opening 100 located in the shaft 93. The electrical interconnections between coils 98 are arranged so that when a current is injected via the conductive leads 99, a total amount of amp-turns will circulate in alternating direction from slot to slot as shown by the series of dot and cross marks. This will create an electromagnet having a series of magnetic poles at the end of each tooth which alternate between south and north from tooth to tooth. Magnetic field leakage lines 101 produced by the poles will extend outwardly from the roller surface between adjacent poles. A ferromagnetic ribbon 102 approaching the roller in parallel with its rotating axis will intercept the magnetic field leakage lines 101 and will be attracted by a magnetic force to stick on the cylinder 90 surface. The magnetic attracting force exerted on the ribbon will be proportional to the current intensity injected in the conductor leads 99.

Figure 15:
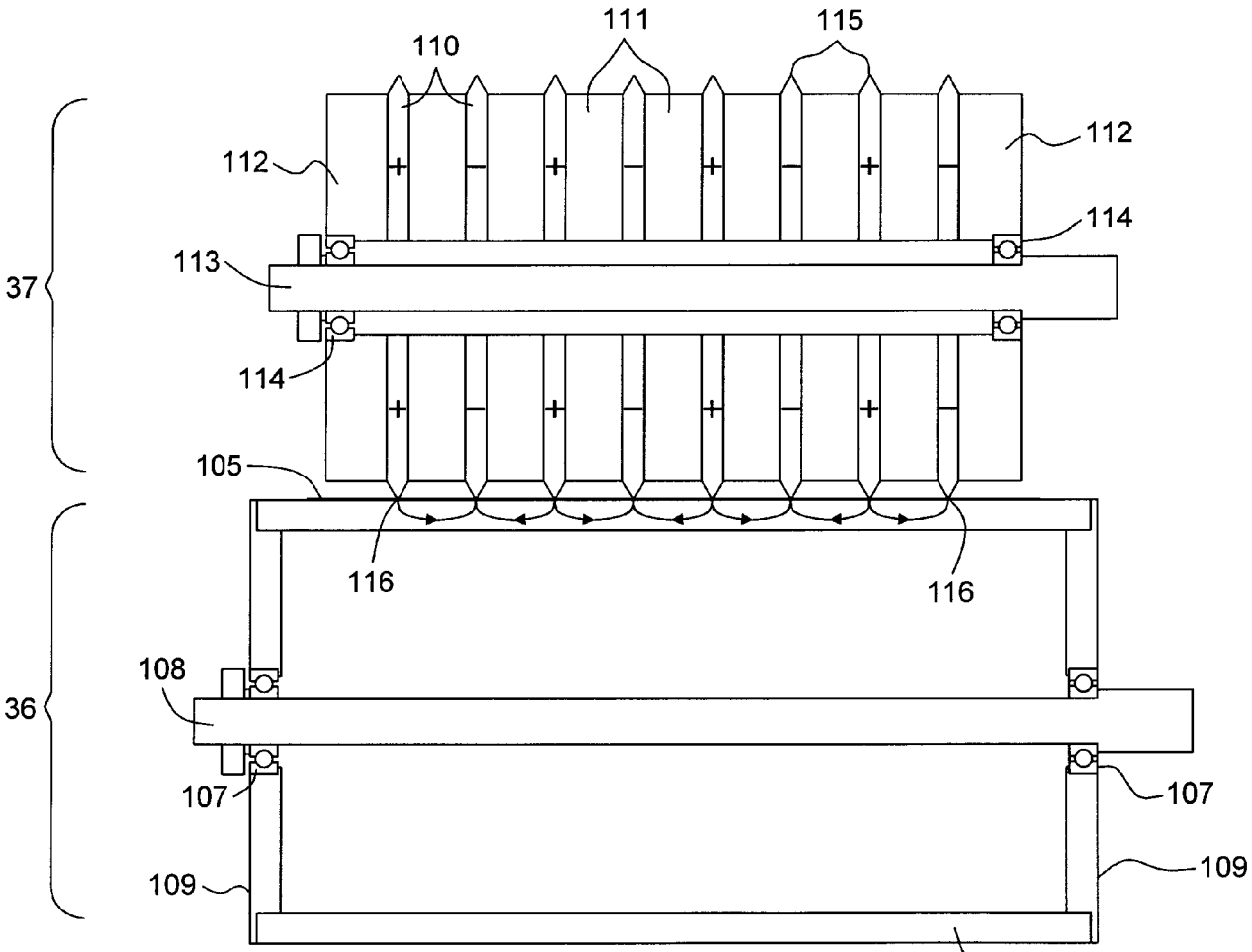
FIG. 15 is a cut view of a welding roller pressing a stack of two ribbons against a conductive roller for welding both ribbons according to another preferred embodiment of the present invention.

Referring now to FIG. 15, there is shown the basic construction of the conductive roller 36 and welding roller 37 used for bounding two stacked metal ribbons 105 together while passing over the conductive roller 36. The conductive roller 36 comprises a cylinder 106 preferably made of copper and having a given thickness. This copper cylinder 106 is mounted with bearings 107 on a shaft 108 via two side flanges 109 to allow its rotation. The outer periphery of the cylinder 106 guides and supports the two stacked metal ribbons 105. The rotating welding roller 37 comprises a series of stacked copper discs 110 separated by insulating spacer discs 111. The group of stacked discs 110 and 111 are squeezed between two insulating flanges 112 each supported on a shaft 113 through bearings 114 to allow the rotation of the stacked discs. Each copper disc 110 has a narrow peripheral tip 115 protruding outwardly from the roller. When the welding roller 37 is pressed against the stacked ribbons 105 on roller 36, the copper discs 110 make a series of spaced narrow contacts 116 distributed along the width of the stacked ribbons. A weld is then created between the two ribbons by forcing a current to flow between the copper discs 110 via the stacked ribbons and the copper cylinder 106. Preferably, the welding current flows between adjacent discs 110 which are alternating in electrical polarity. The current is supplied to the discs through wires and via sliding contacts, not shown, provided on the shaft and connected to an external electrical current source controlled by the controller 30.

Figure 16B:
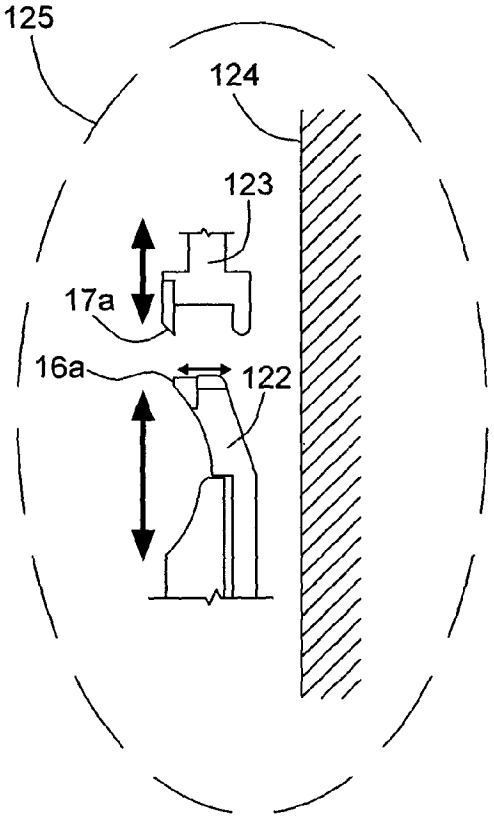
FIG. 16B is a schematic view showing a pair of shear cutting blades according to another preferred embodiment of the present invention.
Figure 16A:
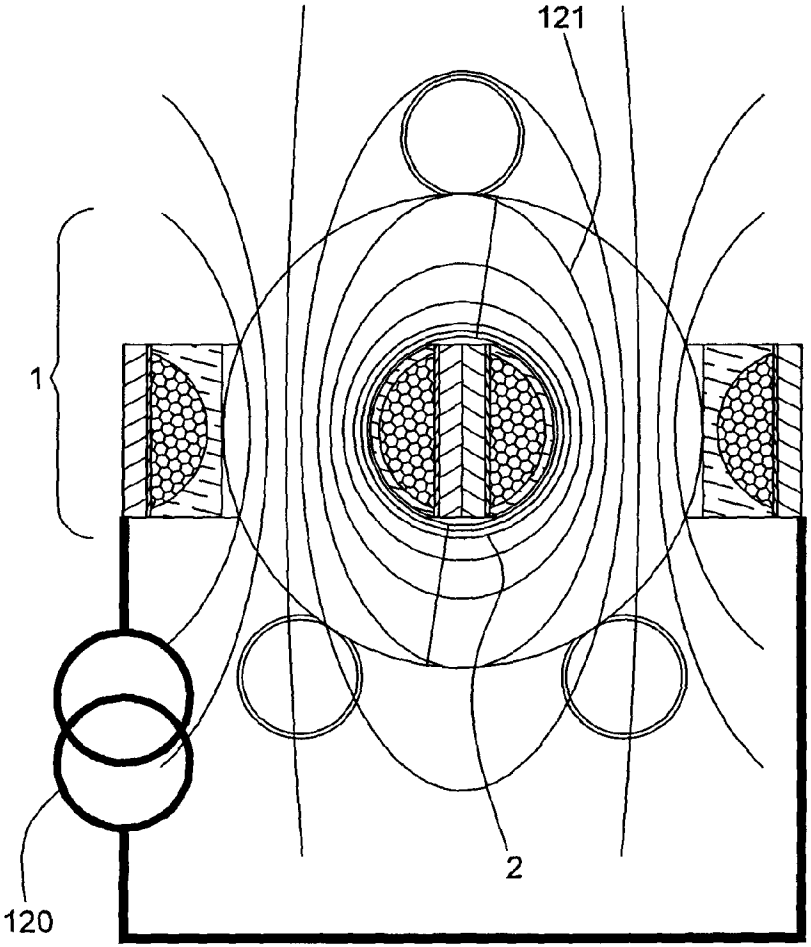
FIG. 16A is a cut view of a transformer kernel with surrounding magnetic field lines induced by a current circulating in the transformer electric coils, according to another preferred embodiment of the present invention.

Referring now to FIG. 16A, the transformer kernel 1 with its empty mandrel 2 is shown from a radial cut view. When a current pulse is injected in at least one of the electric coils of the transformer by an electrical current source 120, induced magnetic field lines 121 are looping around the transformer kernel mandrel 2 when no magnetic core is present.

Referring to FIG. 16B, two shear cutting blades 16*a* and 17*a* are shown, each mounted on a respective supporting member 122 and 123. The supporting members 122 and 123 can be actuated vertically by actuators on guiding rails, not shown, which are mounted in parallel with a reference plane 124 so that the two shear cutting blades 16*a* and 17*a* can closely meet with a very small separating gap. Means, not shown, are provided on one of the blades to change its horizontal position, in order to perform a precise adjustment of the gap. The whole arrangement 125 of cutting blades can be moved with actuators, not shown, to bring them near the rotating mandrel 2 when needed. In the present invention, the ribbon is preferably cut while moving. A shear cut is performed by first positioning blade 16*a* close to the underneath surface of the moving ribbon and then, by actuating blade 17*a* at a sufficient speed, in order to limit the tensioning stress pulse created in the moving ribbon during the cut.

Figure 17:
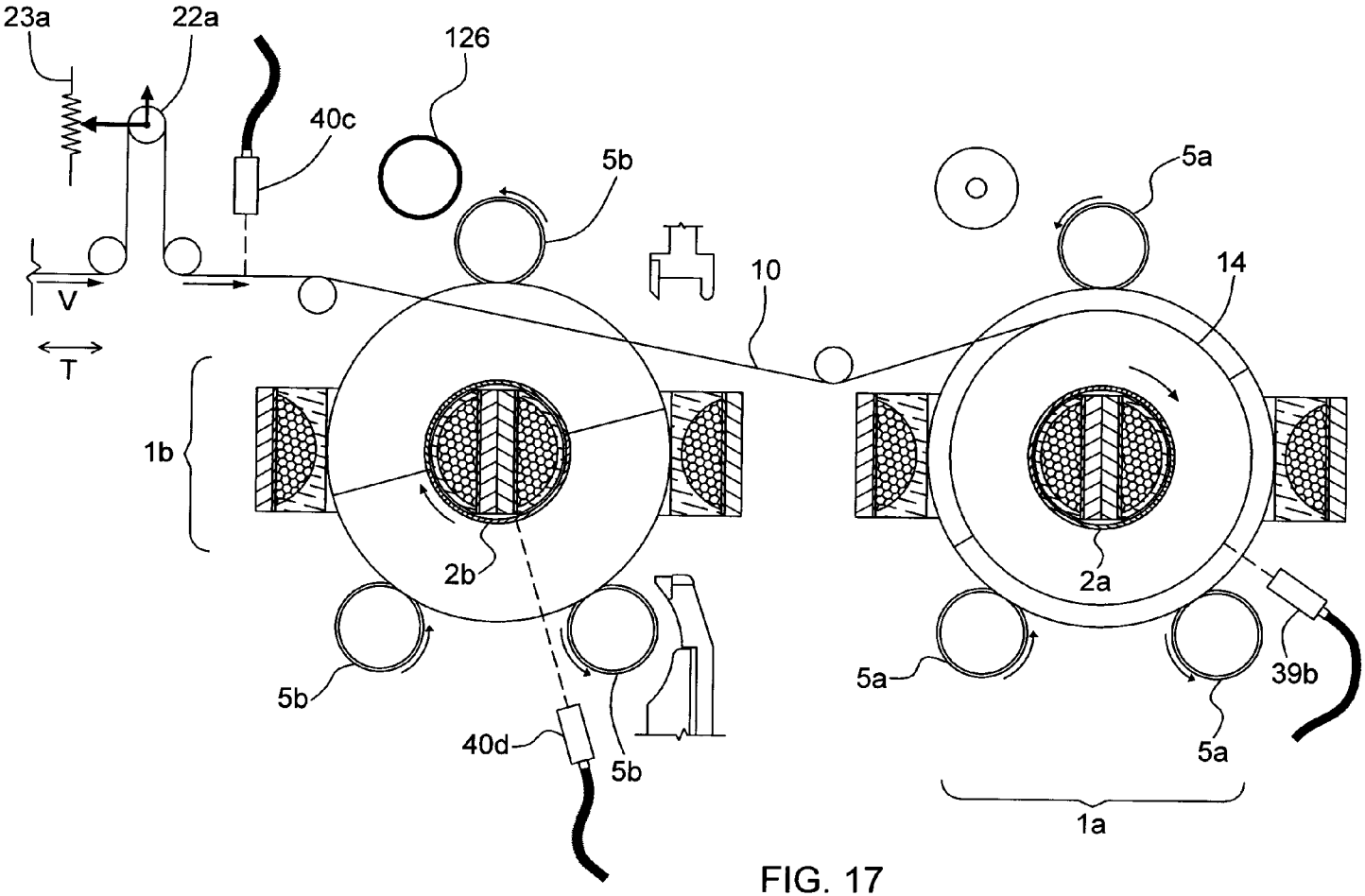
FIGS. 17 to 20 are schematic views showing sequencing events involved for switching a forwarded ribbon from a completed roll rolled up on a transformer kernel mandrel to another empty rotating transformer kernel mandrel, in order to start a new roll, according to another preferred embodiment of the present invention.

FIGS. 17 to 20 show the sequencing events involved for switching a forwarded ribbon from a completed roll 14 rolled up on the mandrel 2*a* of the transformer kernel 1*a* to the empty rotating mandrel 2*b* of the standby transformer kernel 1*b*, in order to start a new roll. Referring first to FIG. 17, a ferromagnetic metal ribbon 10 forwarded at a given speed V and at a tensile stress T from a supply source is being rolled up on the rotating mandrel 2*a*. The rotating speed of mandrel 2*a* is set by the controller 30 using the motorized drive rollers 5*a* according to the position sensor 23*a* linked to the tensioning roller 22*a*. A precise distance sensor 39*b*, such as a laser distance sensor, is aimed at the outer surface of roll 14 to measure and transmit to the controller 30 the amount of accumulating ribbon on mandrel 2*a*. Meanwhile, the transformer kernel 1*b* having the empty mandrel 2*d* is installed upstream to the rolling-up location. A surface velocity sensor 40*c*, such as laser surface velocitymeter, is aimed at the surface of ribbon 10 and continuously transmits the ribbon transferring speed to the controller 30. A surface velocity sensor 40*d* is aimed at the surface of mandrel 2*b* and also continuously transmits the surface rotating speed of mandrel 2*b* to the controller 30. Using both velocity sensors, the mandrel 2*b* is brought into rotation by the controller 30 using drive rollers 5*b* and its rotating speed is set to null the gap computed between the surfaces speeds read from the two velocity sensors 40*c* and 40*d*.

Figure 18:
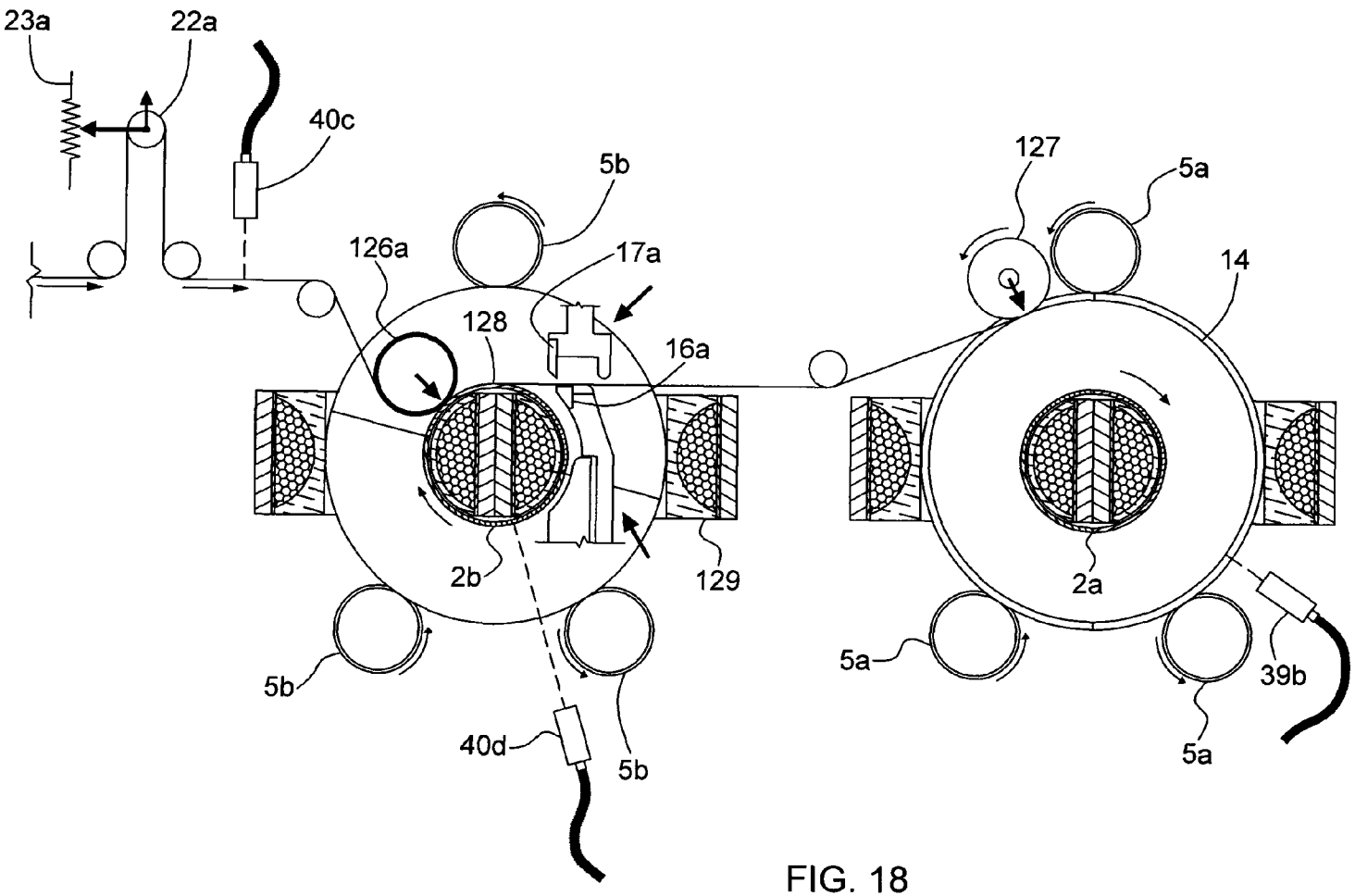

Referring then to FIG. 18, the controller 30 sends an instruction to an actuator linked to an urging roller 126*a*. The urging roller 126*a* is urged on the transferring ribbon 10 against the surface of the rotating mandrel 2*b*. Due to some potential inaccuracy in the sensors 40*c* and 40*d*, there can be a small difference of surface speed between the ribbon 10 and the mandrel 2*b*. Therefore, a torque limit is imposed on the drive rollers 5*b* at a value set barely above the torque level necessary to work against the friction of all rotating parts when the rotating mandrel 2*b* is idling. Once the ribbon 10 is pressed against the mandrel 2*b*, the rotation of mandrel 2*b* becomes belt-driven by the ribbon and its surface rotating speed will match the ribbon forwarded speed. Then, the shear cutting blades 16*a* and 17*a* are brought just past the separating point 128 where the transferring ribbon leaves the surface of mandrel 2*b*. The blade 16*a* is raised between mandrel 2*b* and the left portion of the coils-frame arrangement 129 and is positioned right underneath the surface of the ribbon 10 and, the blade 17*a* is brought over the surface of the ribbon in alignment with blade 16*a*. Meanwhile, the controller 30 sends an instruction to an actuator linked to a welding roller 127, such as the one shown in FIG. 14, in order to press the welding roller 127 against the outer surface of roll 14. The welding roller 127 could also be replaced by a dispenser of a frangible adhesive tape.

Figure 19:
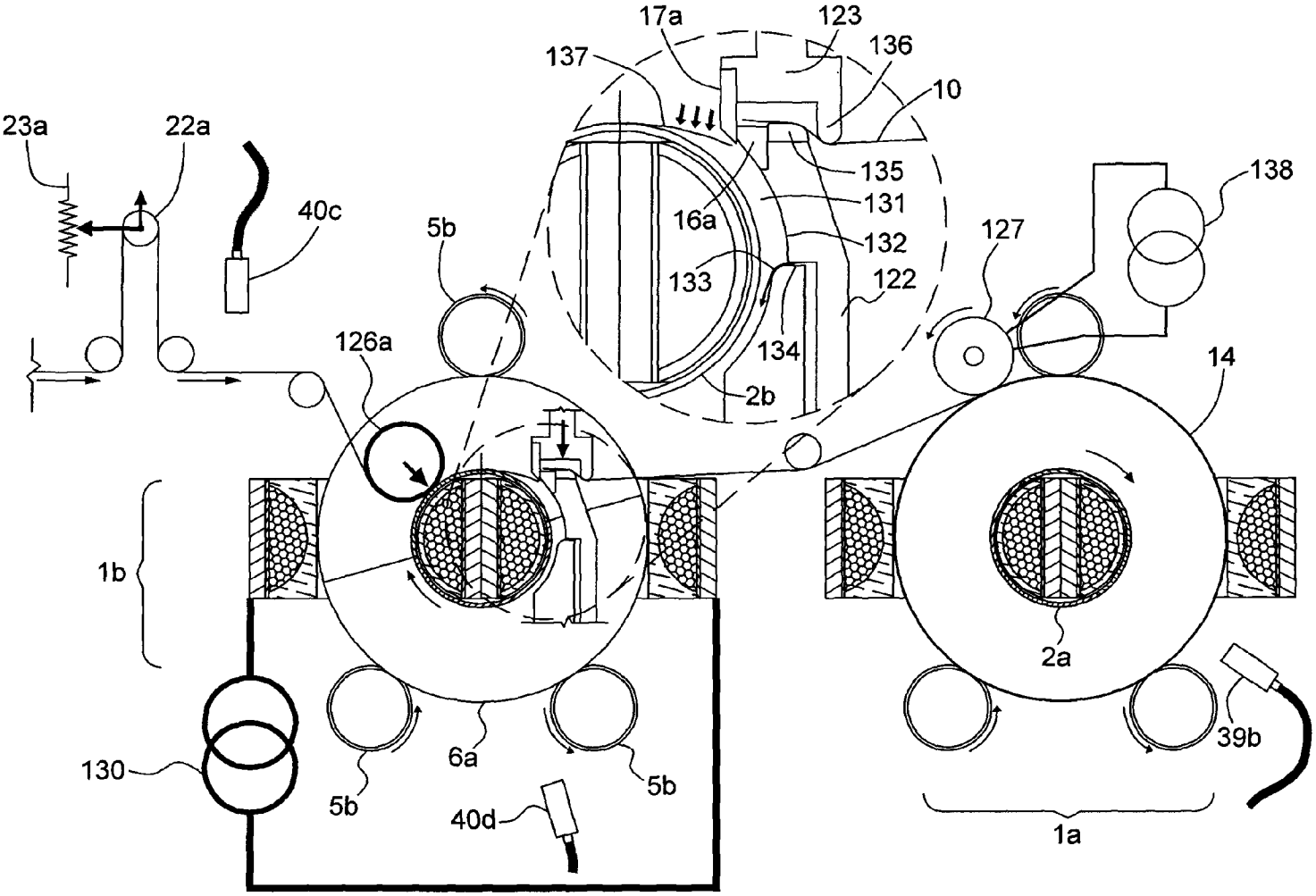

Referring then to FIG. 19, as soon as the targeted amount of ribbon on mandrel 2*a* is reached as detected via the distance sensor 39*b*, the controller 30 activates the actuators of the blades 17*a* to cut the ribbon and, a high current impulse is injected into at least one of the electric coils of the transformer kernel 1*b* using the current source 130 also controlled by the controller 30. Meanwhile, a vacuum is quickly created in the cavity 131 delimited by the mandrel 2*b*, the ribbon 10, both flanges 6*a* and the wall portion 132 of the supporting member 122 by injecting a jet of compressed air clinging over a Coanda profile 133 from a nozzle 134 embedded in the supporting member 122 at the lower portion of the cavity 131. The air is supplied to the nozzle 134 by an actuated valve controlled by the controller 30. The top of the supporting member 122 may be covered with a Teflon-like block 135 to reduce friction when the ribbon is pulled down by the vacuum. As the cutting blades 16*a* and 17*a* cannot be wider than the ribbon, because they would then contact with the rotating flanges 6*a*, a small portion of the ribbon extending beyond the edges of the blades may be left uncut. Therefore, the supporting member 123 can be provided with a hammer head 136 which will hit the ribbon portion at the immediate right location of the block 135 to produce a sudden pulling force on the ribbon trailing end to break the remaining uncut edges. Once the cut is performed, the torque limit imposed on the drive rollers 5*b* is removed and, the feedback input used by the controller 30 to control the rotating speed of mandrel 2*b* is immediately switched from the sensors 40*c* and 40*d* to the position sensor 23*a*. Meanwhile, the region of higher air pressure located above the leading end 137 of the cut ribbon will instantly push it down against the surface of mandrel 2*b* before it passes in front of nozzle 134, at which moment the jet of air will have been already cut off by the controller 30 via the actuated valve. Then, the generated closed loops of magnetic field lines, as shown in FIG. 16A, will produce an attracting force on the ribbon leading end to hold the ribbon end against the surface of mandrel 2*b* until it gets trapped under the second building layer after which, the current impulse generated by the current source 130 may be turned off by the controller 30. Meanwhile, the last set rotating speed on mandrel 2*a* is maintained by the controller 30 while the controller 30 sends an instruction to a current source 138 which will injected a current into the welding roller 127 to weld the last ribbon layer on roll 14 before the arrival of the incoming trailing end after which the welder roller 127 is pulled away and the rotating mandrel 2*a* is brought to a halt. Then, the completed transformer kernel 1*a* is removed.

Figure 20:
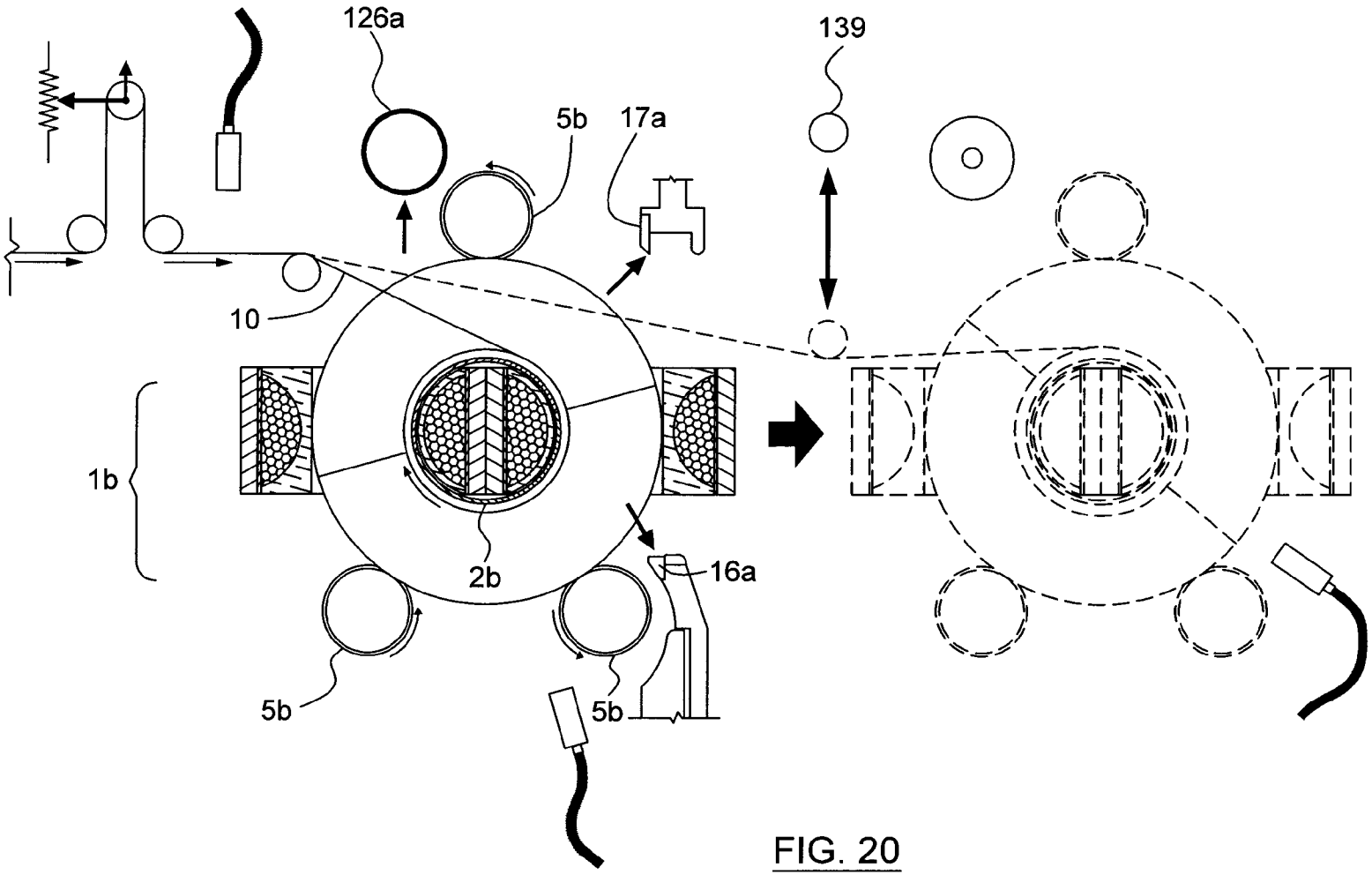

Referring finally to FIG. 20, the urging roller 126*a*, the guide roller 139 and the cutting blades 16*a* and 17*a* are pulled away from the transformer kernel 1*b* with actuators controlled by the controller 30 and, the transformer kernel 1*b* and corresponding coils-frame supporting means and drive rollers 5*b* are slowly moved towards the right by actuators controlled by the controller 30, while the ribbon 10 is being rolled up on the mandrel 2*b*. The transformer kernel 1*b* will switch positions with the supporting means and drive rollers 5*a* that were previously supporting the transformer kernel 1*a* and which are also provided with actuators. Once the positions are switched, the system is then ready to receive a new transformer kernel with an empty mandrel. The new transformer kernel will wait in standby until a next switching sequence is needed and thereby, maintaining a continuous production of rolled up cores on transformer kernel mandrels in series.

Figure 21:
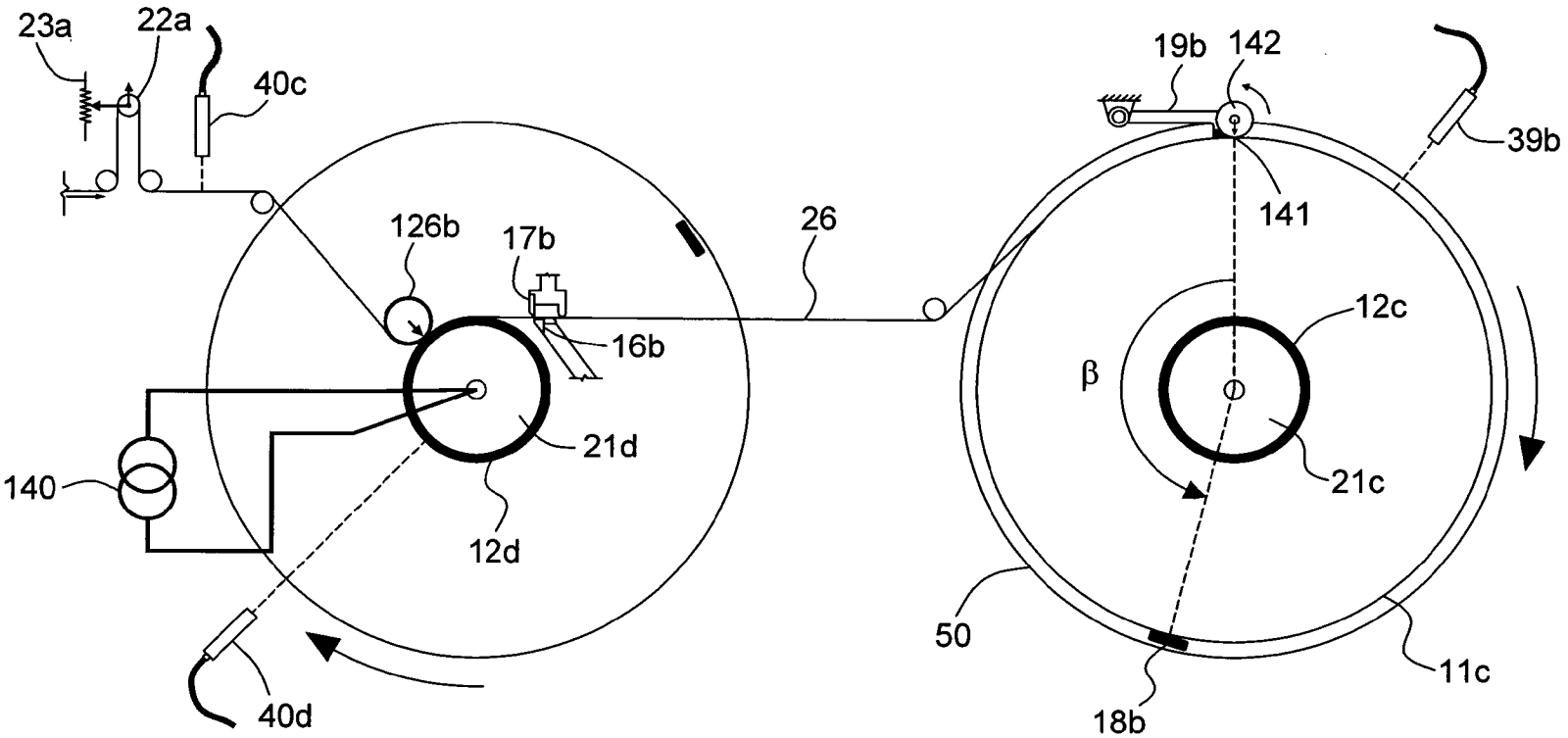
FIG. 21 is a schematic view showing switching of a forwarded ribbon from a completed roll rolled up on a reel mandrel to another empty rotating reel mandrel, in order to start a new roll, according to another preferred embodiment of the present invention.

The method for continuous production of rolled up cores on transformer kernel mandrels can also be applied for rolling up rolls of ribbon on reel mandrels. Referring to FIG. 21, there is shown a setup where a ferromagnetic ribbon 26 is being wound on a reel mandrel 12*c*. The setup comprises: an urging roller 126*b*; a pair of shear cutting blades 16*b* and 17*b*; the distance sensor 39*b*; the pair of surface velocity sensors 40*c* and 40*d*; and the tensioning roller 22*a* with the position sensor 23*a*, all performing similar functions as their corresponding elements described and shown in FIGS. 17 to 20 and with the sequencing events being merely identical but, with the following differences: Firstly, the attraction of the leading end of the cut ribbon on the reel mandrel 12*d* is achieved by injecting a high current impulse in an electromagnet similar to the one shown in FIG. 13 which is located in an hollow portion of the spindle 21*d*. The current impulse is injected by a current source 140 controlled by the controller 30. Usage of a jet of air to create a vacuum under the ribbon, although it could be used, is not necessary in this case as the magnetic pulling force is sufficient. Secondly, once the ribbon is cut, its trailing end is secured on roll 11*c* using the securing device 18*b* provided on the flanges 50 of the reel mandrel 12*d* according to the reverse operating sequence of events shown in FIG. 13A to 13C. The pivoting fingers of the securing device 18*b* are in an opened position waiting to be closed over the trailing end of the incoming ribbon when they will both make a first pass to location point 141 where a swinging lever 19*b* holding pushing pins is swung to flick the pivoting fingers. Also, the ordering command to cut the ribbon is sent by the controller 30 at the moment the securing device 18*b* passes at an angular point β in advance from location point 141, in order to have the securing device 18*b* aligned with the ribbon trailing end on the roll 11*c*. Preferably, an urging roller 142 is temporally pressed against the roll 11*c* near the location point 141 with an actuator controlled by the controller 30, in order to hold the ribbon against the roll 11*c* until the pivoting fingers are closed.

Figure 22:
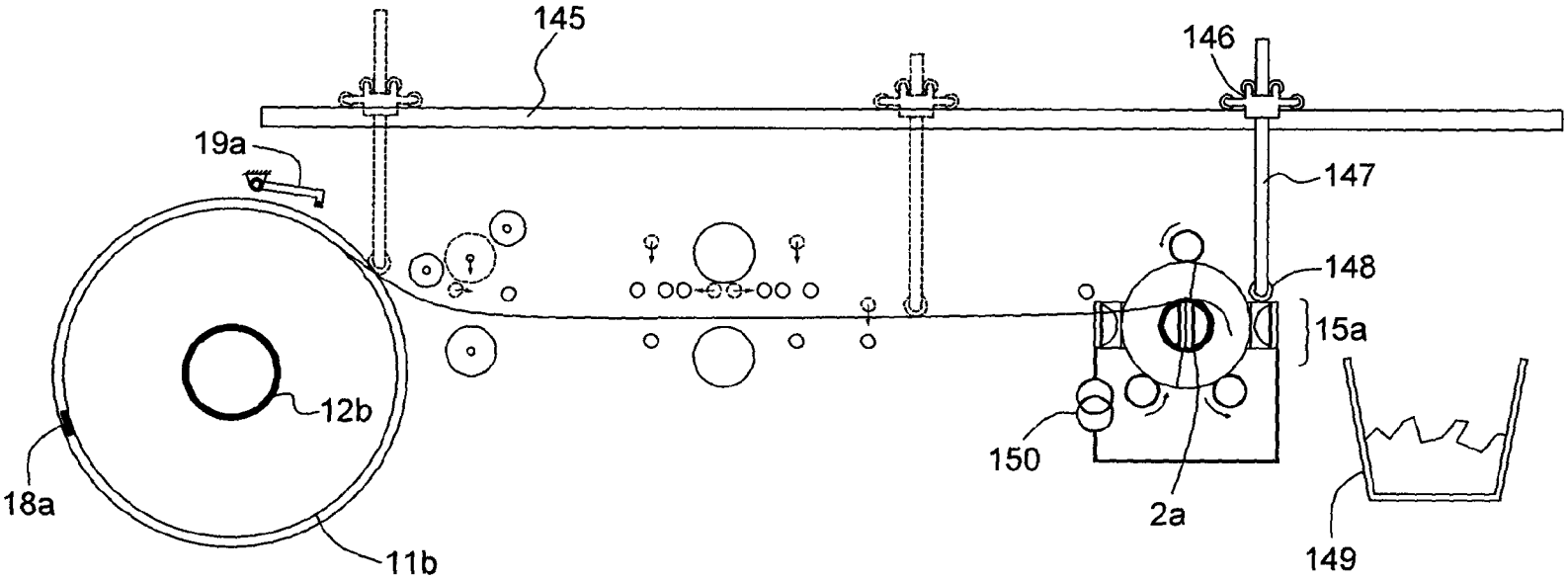
FIG. 22 is a schematic view of an automated system for rolling up a ferromagnetic metal ribbon on transformer kernel mandrels in series which is provided with means for starting up the system, according to another preferred embodiment of the present invention.
Figure 23:
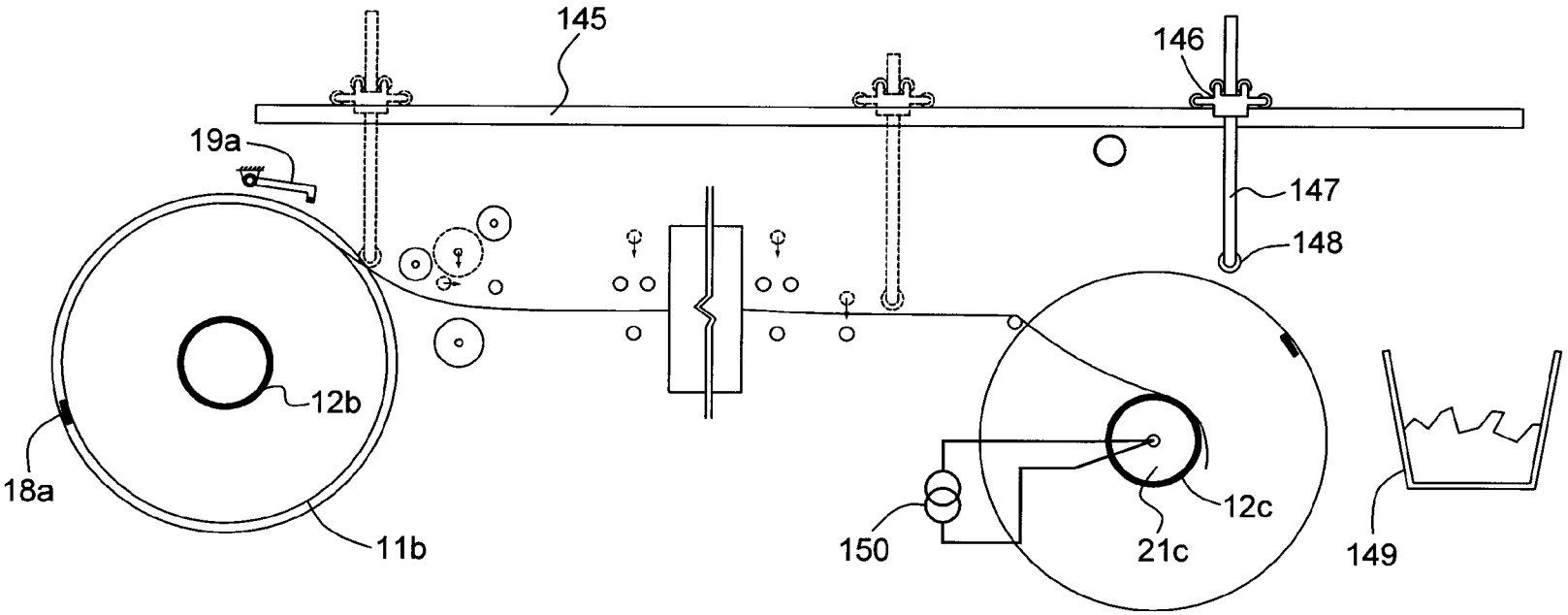
FIG. 23 is a schematic view showing an automated system for rolling up a ferromagnetic metal ribbon on reel mandrels in series which is provided with means for starting up the system.

FIGS. 22 and 23 show an apparatus comprising an arm for seizing and guiding a ribbon end, in order to setup the ribbon transferring system and, for removing ribbon debris stuck in the ribbon transferring system following a ribbon break, in order to cleanup the system. In FIG. 22, the apparatus comprises a rail 145 for supporting a small motorized buggy 146 which can move horizontally. The small buggy also comprises an actuator to vertically displace an arm 147 which holds an electromagnet head 148 from one extremity. The electromagnet head 148, the vertical actuator and the motorised buggy are all controlled by the controller 30. Other means such as a multi-axis robot arm could be employed to hold and move the electromagnet head. To setup the ribbon transferring system, the electromagnet head 148 is energised and brought near the swinging lever 19*a* over the ribbon roll 11*b* having its ribbon free end secured on the roll by the securing device 18*a*. The reel mandrel 12*b* is slowly rotated until the securing device 18*a* gets opened by the swinging lever 19*a* to release the ribbon free end which is then seized by the energized electromagnet head 148. Then, all rollers, around which the ribbon must snake around, are moved by actuators controlled by the controller 30 to provide a straight opened passageway for unrolling and guiding the ribbon leading end by moving the electromagnet head 148 to the right, in order to reach the transformer kernel mandrel 2*a*, or a reel mandrel 12*c* as shown in FIG. 23. The rollers shown are used as an example and therefore, any arrangement of rollers in a ribbon transferring system can be considered. The ribbon leading end is then released on the transformer kernel mandrel 2*a* (or reel mandrel 12*c*) while a current is injected in at least one of the electrical coils of the transformer kernel 1*a* (or in the electromagnet located in the spindle 21*c*) using a current source 150 controlled by the controller 30. The injected current will produce a magnetic force attract and wrap the ribbon around the mandrel 2*a* (or reel mandrel 12*c*). The transformer kernel mandrel 2*a* (or reel mandrel 12*c*) is then slowly rotated a few turns to trap the ribbon free end in the second build layer in the forming roll. Finally, all rollers are moved back to their operating position and the transferring operation can be started.

The same apparatus can be used for resetting the system if a sudden ribbon break occurs during its transfer. Therefore, all rollers and spindles in the system can be provided with means to instantaneously halt their rotation at the moment the ribbon breaks. A ribbon break can be detected by using photo detectors located along the path of the ribbon and connected to the controller 30 or, by detecting a sudden change in the torque or rotating speed of one of the motorized spindles or drive rollers. Quickly halting all rotating parts will prevent the ribbon from rolling-up on free wheeling rollers. Following the break and after all rotating parts are halted, the rollers are moved to open the passageway. The ribbon portion hanging down from roll 11*b* is cut using cutting means, not shown, provided on the arm 147 or near roll 11*b*. Starting from the cut tail, the debris of ribbon stuck in the rollers are picked up by the electromagnet head 148 while moving up to the far right where the picked up ribbon debris are then dropped in a recycling basket 149. Preferably, the transformer kernel 1*a* (or reel mandrel 12*c*) is removed and replaced with one having an empty mandrel and, the removed transformer kernel (or reel mandrel) is sent for inspection where it will be refurbished or recycled. Meanwhile, the electromagnet head 148 is brought back near the roll 11*b* to seize the ribbon free end and the setup procedure as described hereinabove is redone.

Although preferred embodiments of the present invention have been described in detailed herein and illustrated in the accompanying drawings, it is to be understood that the invention is not limited to these precise embodiments and that various changes and modifications may be effected therein without departing from the scope of the present invention.

What is claimed:

1. An apparatus for securing a free end of a ribbon roll on an outer surface of said ribbon roll, the apparatus comprising:

a rotatable reel comprising:

a mandrel onto which the ribbon roll is mounted;

first and second lateral flanges on opposite sides of the mandrel; and a ribbon retention mechanism having retaining elements mounted on the first and second lateral flanges and movable between a retaining position, where the retaining elements apply a radial force on the free end of the ribbon roll to retain the free end of the ribbon roll against the outer surface of the ribbon roll, and a releasing position, where the retaining elements are removed from contact with the free end of the ribbon roll to release the free end of the ribbon roll; and at least one actuated element configured to move the retaining elements from the releasing position to the retaining position to secure the free end of the ribbon roll as the rotatable reel is rolling up the ribbon roll, and to move the retaining elements from the retaining position to the releasing position to release and launch the free end of the ribbon roll along a direction tangential to the outer surface of the ribbon roll as the rotatable reel is unrolling the ribbon roll.

2. The apparatus according to claim 1, wherein each one of the first and second lateral flanges comprises a slot configured to receive therein a respective one of the retaining elements, and wherein each one of the retaining elements comprises a rod that is pivotable with respect to the respective one of the first and second lateral flanges, the rod being pivotable between the retaining position, where the rod extends toward the one other than the respective one of the first and second lateral flanges, and the releasing position, where the rod is housed within the respective slot.

3. The apparatus according to claim 2, wherein each rod is configured to make an initial movement radially outwardly away from the free end of the ribbon roll during the pivoting between the retaining position and the releasing position.

4. The apparatus according to claim 2, further comprising:

a motorized spindle onto which the rotatable reel is mounted on;

a thickness sensor configured to measure a thickness of the ribbon roll mounted on the mandrel;

an angular position sensor configured to determine an angular position of the ribbon retention mechanism on the rotatable reel; and a controller comprising inputs connected to the thickness and angular position sensors for reading the thickness of the ribbon roll measured by the thickness sensor and the angular position of the ribbon retention mechanism on the rotatable reel determined by the angular position sensor, and outputs connected to the motorized spindle and the at least one actuated element for controlling a rotation of the rotatable reel via the motorized spindle and a movement of the retaining elements via the at least one actuated element.

5. A method for rolling up a cuttable ferromagnetic ribbon on a mandrel, comprising the steps of:

a) supplying a free end of said cuttable ferromagnetic ribbon in proximity of said mandrel;

b) simultaneously injecting a current by a controllable current source into an electromagnet located in said mandrel, to produce a magnetic field to directly attract and urge said free end onto the mandrel, and rotating said mandrel to roll up said ribbon on said mandrel;

c) cutting the ferromagnetic ribbon when a predetermined diameter of ferromagnetic ribbon rolled up on the mandrel has been attained.

6. The method according to claim 5, wherein in step b), the electromagnet comprises at least one conductor coil of a transformer kernel.

7. The method according to claim 5, wherein in step b), the electromagnet comprises at least one conductor coil mounted on a ferromagnetic yoke.

8. The method according to claim 7, wherein in step b), the ferromagnetic yoke is mounted on a shaft and is housed within the mandrel, the ferromagnetic yoke comprising a plurality of annular-shaped slots spaced-apart along the shaft, said slots receiving the at least one conductor coil, the at least one conductor coil being wound such that current injected in the coil circulates in alternating rotational directions between adjacent slots.

9. An apparatus for rolling up a cuttable ferromagnetic ribbon roll, comprising:

a mandrel;

an electromagnet located in said mandrel;

a controllable motor to rotate the mandrel;

a controllable current source for injecting a current into the electromagnet;

a controller for controlling the controllable current source and the controllable motor, to produce a magnetic field to directly attract and urge a free end of the ribbon onto the mandrel as the mandrel is rotating thereby rolling up the cuttable ferromagnetic ribbon roll on the mandrel; and a cutter for cutting the ferromagnetic ribbon when a predetermined diameter of ferromagnetic ribbon rolled up on the mandrel has been attained.

10. The apparatus according to claim 9, wherein the electromagnet comprises at least one conductor coil of a transformer kernel.

11. The apparatus according to claim 9, wherein the electromagnet comprises at least one conductor coil mounted on a ferromagnetic yoke.

12. The apparatus according to claim 11, wherein the ferromagnetic yoke is mounted on a shaft and is housed within the mandrel, the ferromagnetic yoke comprising a plurality of annular-shaped slots spaced-apart along the shaft, said slots receiving the at least one conductor coil, the at least one conductor coil being wound such that current injected in the coil circulates in alternating rotational directions between adjacent slots.

13. A method for transferring a ferromagnetic ribbon from a ferromagnetic ribbon roll mounted on a first reel to a first mandrel, comprising the steps of:

a) positioning the first reel at a first unrolling position;

b) securing a free end of the ribbon roll on an outer surface of the ribbon roll by a ribbon retention mechanism having retaining elements movable between a retaining position, where the retaining elements apply a radial force on the free end of the ribbon roll to retain the free end of the ribbon roll against the outer surface of the ribbon roll, and a releasing position, where the retaining elements are removed from contact with the free end of the ribbon roll to release the free end of the ribbon roll;

c) positioning an electromagnet proximate to the first reel;

d) rotating the first reel with the free end secured in step b);

e) after step d), simultaneously triggering the retaining elements from the retaining position to the releasing position to free the free end of the ribbon roll, and injecting current into the electromagnet to produce a first magnetic field to directly attract and capture the free end of the ribbon roll;

f) displacing the free end captured in step e) along a path proximate to the first mandrel at a first rolling up position;

g) simultaneously releasing the free end of the ribbon roll by stopping the step of injecting current into the electromagnet, injecting a current by a controllable current source into a mandrel electromagnet located in said first mandrel, to produce a second magnetic field to directly attract and urge said free end onto the first mandrel, and rotating said first mandrel to roll up said ribbon roll on said first mandrel; and h) cutting the ferromagnetic ribbon when a predetermined diameter of ferromagnetic ribbon rolled up on the first mandrel has been attained.

14. The method according to claim 13, further comprising the step of:

i) securing a free end of the ferromagnetic ribbon rolled up on the first mandrel, obtained after the cutting step h), onto the ribbon roll on the first mandrel.

15. The method according to claim 14, wherein, in step i), the step of securing comprises the step of securing the free end of the ribbon roll on the first mandrel by a second ribbon retention mechanism having retaining elements movable between a retaining position, where the retaining elements apply a radial force on the free end of the ribbon roll to retain the free end of the ribbon roll against the outer surface of the ribbon roll, and a releasing position, where the retaining elements are removed from contact with the free end of the ribbon roll to release the free end of the ribbon roll.

16. The method according to claim 14, wherein, in step i), the step of securing comprises the step of welding the free end of the ribbon roll on the first mandrel onto said ribbon roll on the first mandrel.

17. The method according to claim 13, further comprising the steps of:

j) between steps g) and h), positioning a second mandrel at a second rolling up position proximate to the path of the ribbon between the first reel and the first mandrel;

k) simultaneously with step h), injecting a current of a second controllable current source into a second mandrel electromagnet located in said second mandrel, to urge the free end of the ribbon from the first reel cut in step h) onto the second mandrel, and rotating said second mandrel to roll up said ribbon on said second mandrel;

l) removing the first mandrel from the first rolling up position;

m) moving the second mandrel from the second rolling up position to the first rolling up position;

n) cutting the ferromagnetic ribbon when a second predetermined diameter of ferromagnetic ribbon rolled up on the second mandrel positioned in the second position has been attained; and o) repeating steps j) to n), until the first reel positioned in the first unrolling position is empty, to unroll and roll up the ribbon roll on a plurality of mandrels.

18. The method according to claim 17, further comprising the steps of:

p) providing a second reel having a second ribbon roll at a second unrolling position proximate to the path of the ribbon between the first reel and the first mandrel;

q) securing a free end of the second ribbon roll on an outer surface of the second ribbon roll by a second ribbon retention mechanism having retaining elements movable between a retaining position, where the retaining elements apply a radial force on the free end of the second ribbon roll to retain the free end of the second ribbon roll against the outer surface of the second ribbon roll and a releasing position, where the retaining elements are removed from contact with the free end of the second ribbon roll to release the free end of the second ribbon roll;

r) rotating the second reel with the free end secured in step q);

s) during the repeating step o) before the first reel becomes empty, triggering the retaining elements of the second reel from the retaining position to the releasing position to free the free end of the second ribbon roll and joining the free end of the second ribbon with the first ribbon of the first reel;

t) after step s), removing the first reel from the first unrolling position, after the first reel is emptied;

u) after step t), moving the second reel from the second unrolling position to the first unrolling position; and v) repeating steps p) to u) continuously, to unroll ribbon rolls continuously from the reels.

19. The method according to claim 18, wherein, in step s), the step of joining comprises the steps of:

i) injecting a current by a controllable current source into an electromagnet located in an attractor roller, to urge the free end of the second ribbon onto the first ribbon; and ii) after step i) welding the first and second ribbons together.

20. The method according to claim 19, wherein, in step ii), the step of welding is carried out by a rotating welder which is mounted on a shaft and comprises a plurality of conductor discs separated by insulating spacer discs, each conductor disc having a narrow tip protruding outwardly from the shaft, the conductor discs being electrically connected such that current polarity alternates between adjacent conductor discs, and the tips of the conductor discs being pressed against the first and second ribbons.

21. The method according to claim 13, further comprising the steps of:

AA) positioning the electromagnet of step c) proximate to debris of the ribbon generated upon breakage of the ribbon between the first reel and the first mandrel;

BB) injecting current into the electromagnet of step c) to capture the debris;

CC) displacing the debris captured in step BB) to a disposal location; and

DD) releasing the debris at the disposal location by stopping the step of injecting current into the electromagnet of step c).

22. A system for transferring a ferromagnetic ribbon from a ferromagnetic ribbon roll mounted on a first reel to a first mandrel, comprising:

a first positioning system for positioning the first reel at a first unrolling position;

a first ribbon retention mechanism having retaining elements movable between a retaining position, where the retaining elements apply a radial force on a free end of the ribbon roll to retain the free end of the ribbon roll against an outer surface of the ribbon roll, and a releasing position, where the retaining elements are removed from contact with the free end of the ribbon roll to release the free end of the ribbon roll;

a first electromagnet;

a controllable displacement system for displacing the first electromagnet along a path;

a first controllable current source for injecting current into said first electromagnet;

a first controller for controlling the controllable displacement system and the controllable current source to sequentially capture, displace and release the ribbon as said first electromagnet moves along said path;

a first controllable motor for rotating the first reel;

a first triggering system for triggering the retaining elements from the retaining position to the releasing position to free the free end of the ribbon;

a second controller for controlling the first triggering system, the first controllable current source and the first controllable motor, for simultaneously triggering the retaining elements from the retaining position to the releasing position as the first reel is rotating to free the free end of the ribbon roll as current is injected into the first electromagnet to produce a first magnetic field to directly attract and capture the free end of the ribbon roll;

a second positioning system for positioning the first mandrel at a first rolling up position;

a second electromagnet located in said first mandrel;

a second controllable motor to rotate the first mandrel;

a second controllable current source for injecting a current into the second electromagnet;

a third controller for controlling the second controllable current source and the second controllable motor, to produce a second magnetic field to directly attract and urge a free end of the ribbon roll as the first mandrel is rotating thereby rolling up the cuttable ferromagnetic ribbon roll on the first mandrel; and a cutter for cutting the ferromagnetic ribbon when a predetermined diameter of ferromagnetic ribbon rolled up on the first mandrel has been attained.

23. The system according to claim 22, further comprising a securing apparatus for securing a free end of the ferromagnetic ribbon rolled up on the first mandrel, obtained after cutting by the cutter, onto the ribbon roll on the first mandrel.

24. The system according to claim 23, wherein the securing apparatus comprises a second ribbon retention mechanism having retaining elements movable between a retaining position in which the free end of the ribbon roll on the first mandrel is secured on the first mandrel and a releasing position in which the free end of the ribbon roll on the first mandrel is free from the first mandrel.

25. The system according to claim 23, wherein the securing apparatus comprises a welder for welding the free end of the ribbon roll on the first mandrel onto said ribbon roll on the first mandrel.

26. The system according to claim 22, further comprising:

a second positioning system for positioning a second mandrel between a second rolling up position proximate to the path of the ribbon between the first reel and the first mandrel, and the first rolling up position;

a third electromagnet located in said second mandrel;

a third controllable motor to rotate the second mandrel;

a third controllable current source for injecting a current into the third electromagnet;

a fourth controller for controlling the third controllable current source and the third controllable motor, to urge a free end of the ribbon roll on the second mandrel as the second mandrel is rotating thereby rolling up the cuttable ferromagnetic ribbon roll on the second mandrel.

27. The system according to claim 26, further comprising:

a third positioning system for positioning a second reel having a second ribbon roll between a second unrolling position proximate to the path of the ribbon between the first reel and the first mandrel, and the first unrolling position;

a second ribbon retention mechanism having retaining elements movable between a retaining position, where the retaining elements apply a radial force on a free end of the second ribbon roll against an outer surface of the second ribbon roll, and a releasing position, where the retaining elements are removed from contact with the free end of the second ribbon roll to release the free end of the second ribbon roll;

a fourth controllable motor for rotating the second reel;

a second triggering system for triggering the retaining elements from the retaining position to the releasing position to free the free end of the second ribbon;

a fifth controller for controlling the second triggering system and the fourth controllable motor, for simultaneously triggering the retaining elements of the second ribbon retention mechanism from the retaining position to the releasing position as the second reel is rotating to free the free end of the second ribbon;

an attractor roller;

a fourth electromagnet located in said attractor roller;

a fifth controllable motor to rotate the attractor roller;

a fourth controllable current source for injecting current into the fourth electromagnet;

a rotating welder for welding the first and second ribbons together; and a sixth controller for controlling the fourth controllable current source, the fifth controllable motor, and the rotating welder, to urge the free end of the second ribbon and the first ribbon onto the attractor roller, and weld the first and second ribbons together.

28. The system according to claim 27, wherein the rotating welder is mounted on a shaft and comprises a plurality of conductor discs separated by insulating spacer discs, each conductor disc having a narrow tip protruding outwardly from the shaft, the conductor discs being electrically connected such that current polarity alternates between adjacent conductor discs, and the tips of the conductor discs being pressed against the first and second ribbons.

* * * * *